US010852650B2

(12) United States Patent
Inoue et al.

(10) Patent No.: US 10,852,650 B2
(45) Date of Patent: Dec. 1, 2020

(54) TONER AND METHOD FOR PRODUCING THE TONER

(71) Applicant: CANON KABUSHIKI KAISHA, Tokyo (JP)

(72) Inventors: Koki Inoue, Numazu (JP); Takeshi Tsujino, Mishima (JP); Yasuhiro Hashimoto, Mishima (JP); Junya Asaoka, Mishima (JP); Yuu Sasano, Susono (JP); Kenta Katayama, Kashiwa (JP); Shota Amano, Yokohama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/259,104

(22) Filed: Jan. 28, 2019

(65) Prior Publication Data

US 2019/0235402 A1 Aug. 1, 2019

(30) Foreign Application Priority Data

Jan. 30, 2018 (JP) ..... 2018-013690
Oct. 17, 2018 (JP) ..... 2018-195525

(51) Int. Cl.
*G03G 9/08* (2006.01)
*G03G 9/087* (2006.01)
*G03G 9/083* (2006.01)

(52) U.S. Cl.
CPC ..... *G03G 9/0821* (2013.01); *G03G 9/0806* (2013.01); *G03G 9/0819* (2013.01); *G03G 9/0825* (2013.01); *G03G 9/08782* (2013.01); *G03G 9/08797* (2013.01); *G03G 9/083* (2013.01)

(58) Field of Classification Search
CPC .. G03G 9/0821; G03G 9/0806; G03G 9/0819; G03G 9/08782; G03G 9/08797; G03G 9/083; G03G 9/0825
USPC ..... 430/110.1
See application file for complete search history.

(56) References Cited

U.S. PATENT DOCUMENTS

| | | | |
|---|---|---|---|
| 5,601,913 | A | 2/1997 | Ohtani et al. |
| 6,309,788 | B1 | 10/2001 | Tsujino et al. |
| 6,953,648 | B2 | 10/2005 | Tsujino et al. |
| 7,112,393 | B2 | 9/2006 | Komoro et al. |
| 7,368,212 | B2 | 5/2008 | Sugiura et al. |
| 7,459,253 | B2 | 12/2008 | Abe et al. |
| 7,494,758 | B2 | 2/2009 | Tsujino et al. |

(Continued)

FOREIGN PATENT DOCUMENTS

| | | |
|---|---|---|
| JP | 2005-017582 | 1/2005 |
| JP | 2005-134497 | 5/2005 |

(Continued)

*Primary Examiner* — Mark A Chapman
(74) *Attorney, Agent, or Firm* — Venable LLP

(57) ABSTRACT

A toner has a toner particle including a binder resin, a colorant, and a wax, in which in a cross section of the toner particle observed under a scanning transmission electron microscope, a proportion of the number of toner particles having a void with a long diameter of 0.50 μm or less is 60 number % or more, and a proportion of the number of toner particles having a void in a region from an outline of the cross section of the toner particle inward to 1.00 μm in a total number of the toner particles having a void is 30 number % or less.

3 Claims, 3 Drawing Sheets

(56) References Cited

U.S. PATENT DOCUMENTS

| | | | | |
|---|---|---|---|---|
| 8,053,156 | B2 | 11/2011 | Abe et al. | |
| 8,247,147 | B2 | 8/2012 | Abe et al. | |
| 8,367,289 | B2 | 2/2013 | Isono et al. | |
| 8,440,382 | B2 | 5/2013 | Isono et al. | |
| 8,497,054 | B2 | 7/2013 | Sugiyama et al. | |
| 8,545,133 | B2 | 10/2013 | Fumita et al. | |
| 8,652,737 | B2 | 2/2014 | Handa et al. | |
| 8,778,581 | B2 | 7/2014 | Nonaka et al. | |
| 8,916,319 | B2 | 12/2014 | Ikeda et al. | |
| 8,940,467 | B2 | 1/2015 | Hashimoto et al. | |
| 9,023,570 | B2 * | 5/2015 | Shiba | G03G 9/0819 430/108.1 |
| 9,229,345 | B2 | 1/2016 | Ikeda et al. | |
| 9,341,967 | B2 | 5/2016 | Tsujino et al. | |
| 9,366,981 | B2 | 6/2016 | Yamawaki et al. | |
| 9,423,714 | B2 | 8/2016 | Kenmoku et al. | |

FOREIGN PATENT DOCUMENTS

| | | |
|---|---|---|
| JP | 2006-106315 | 4/2006 |
| JP | 2007-034128 | 2/2007 |
| JP | 2010-049116 | 3/2010 |
| JP | 2011-500884 | 1/2011 |
| JP | 2011-059372 | 3/2011 |
| JP | 2012-108475 | 6/2012 |
| JP | 5493612 | 5/2014 |
| JP | 2015-075737 | 4/2015 |
| JP | 5990881 | 9/2016 |
| JP | 6068312 | 1/2017 |
| JP | 2017-137366 | 8/2017 |
| WO | 2009/048508 | 4/2009 |

* cited by examiner

TONER AND METHOD FOR PRODUCING THE TONER

BACKGROUND OF THE INVENTION

Field of the Invention

The present invention relates to a toner for visualizing an electrostatic charge image in an image forming method such as electrophotography, electrostatic printing, and magnetic recording, and to a method for producing the toner.

Description of the Related Art

In recent years, a demand has been created for printers and copying machines in which high-definition images are obtained by digitization and, at the same time, the speed of printing or copying is increased, and no image defects appear even in long-term use and use under a high-temperature and high-humidity environment or a low-temperature and low-humidity environment.

One of the causes of image defects is that because toner particles including a large number of voids are used for electrophotography, the toner particles crack owing to the shear occurring between functional parts, which results in fusion of the particles to parts in the cartridge and occurrence of development streaks.

In addition, parts are contaminated by the cracked toner particles and fogging occurs due to poor charging.

Furthermore, where the surface of a toner particle is chipped due to the voids in the vicinity of the surface layer of the toner particle, wax exudes from the chipped portion. Consequently, contamination of parts, such as contamination of a toner bearing member or filming on a photosensitive member, is likely to occur. As a result, there arises a problem that image quality is deteriorated.

To meet the above requirement, Japanese Patent No. 6068312 discloses a method for obtaining a capsule-type toner excellent in both fixing performance and heat-resistant storability by adjusting a ratio of an average diameter of bubbles in a shell layer to an average thickness of the shell layer in the cross section of the shell layer.

In addition, Japanese Patent No. 5990881 discloses defining the size and proportion of voids in a toner particle obtained by granulation in an aqueous phase. As a result, it is possible to obtain a toner with improved strength against stress which is excellent in resistance to contamination and bleeding (smear) caused by rubbing of the image after fixing, demonstrates reduced occurrence of filming, and makes it possible to obtain a high-quality image.

Further, in Japanese Patent No. 5493612, it is indicated that by adjusting the void size and the void ratio of a toner particle, it is possible to prevent deterioration of image quality occurring due to deformation or breakage of toner particle caused by mechanical stress added in development or transfer, while maintaining fixing performance

SUMMARY OF THE INVENTION

With the simple control of the average diameter of bubbles in the shell layer, as in the toner disclosed in Japanese Patent No. 6068312, it is somewhat difficult to suppress cracking and chipping of the toner particles caused by the presence of bubbles in the vicinity of the surface of the toner.

When the size and proportion of voids are simply specified, as in the toner disclosed in Japanese Patent No. 5990881, it is somewhat difficult to suppress cracking and chipping of the toner particle caused by the presence of bubbles in the vicinity of the surface of the toner particle.

When large voids are present in the vicinity of the surface of the toner particle, as in the toner disclosed in Japanese Patent No. 5493612, the resistance to stress is not sufficient and it is somewhat difficult to prevent deterioration of image quality.

Further, in any of the above-mentioned disclosures, it is somewhat difficult to suppress exudation of wax due to chipping in the vicinity of the surface layer of a toner particle.

The present invention provides a toner which solves the above problems.

That is, the present invention provides a toner that excels in strength against stress applied from outside to a toner particle and that demonstrates no image defects such as development streaks and fogging caused by cracking due to shear occurring between functional parts in long-term use or use under a high-temperature and high-humidity environment. The present invention also provides a method for producing such a toner.

Provided also are a toner that demonstrates no image defects such as fogging caused by contamination of parts due to exudation of wax onto the toner particle surface, and a method for producing such as toner.

The present invention relates to a toner having a toner particle including a binder resin, a colorant, and a wax, wherein in a cross section of the toner particle observed under a scanning transmission electron microscope, a proportion of the number of toner particles having a void with a long diameter of 0.50 μm or less is 60 number % or more, and a proportion of the number of toner particles having a void in a region from an outline of the cross section of the toner particle inward to 1.00 μm in a total number of the toner particles having a void is 30 number % or less.

The present invention relates to a method for producing the toner, comprising a step of forming the toner particle in an aqueous medium, wherein the step of forming the toner particle has the following step (a) or step (b):

(a) a granulation step of forming a particle of a polymerizable monomer composition including a polymerizable monomer capable of forming the binder resin, the colorant, and the wax in the aqueous medium, and a polymerization step of forming a toner particle by polymerizing the polymerizable monomer contained in the particle of the polymerizable monomer composition after the granulation step, (b) a granulation step of dispersing a mixed solution in which a toner particle composition including the binder resin, the colorant, and the wax and an organic solvent capable of dissolving the binder resin are mixed in the aqueous medium to form a particle of the mixed solution, and a solvent removal step of removing the organic solvent present in the particle of the mixed solution after the granulation step to form a toner particle, and in the granulation step in the step (a) or (b), the granulation is performed by causing circulation flow of the polymerizable monomer composition or the mixed solution and the aqueous medium in a circulation flow path including a tank I in which a stirring means is installed, and provided with a device having a defoaming function.

According to the present invention, it is possible to provide a toner that excels in strength against stress applied from outside to a toner particle and that demonstrates no image defects such as development streaks and fogging caused by cracking due to shear occurring between functional parts in long-term use or use under a high-temperature and high-humidity environment, and to provide a method for producing such a toner.

A toner that demonstrates no image defects such as fogging caused by contamination of parts due to exudation of wax onto the toner particle surface, and a method for producing such as toner can also be provided.

Further features of the present invention will become apparent from the following description of exemplary embodiments with reference to the attached drawing.

DESCRIPTION OF THE EMBODIMENTS

Figure 1:
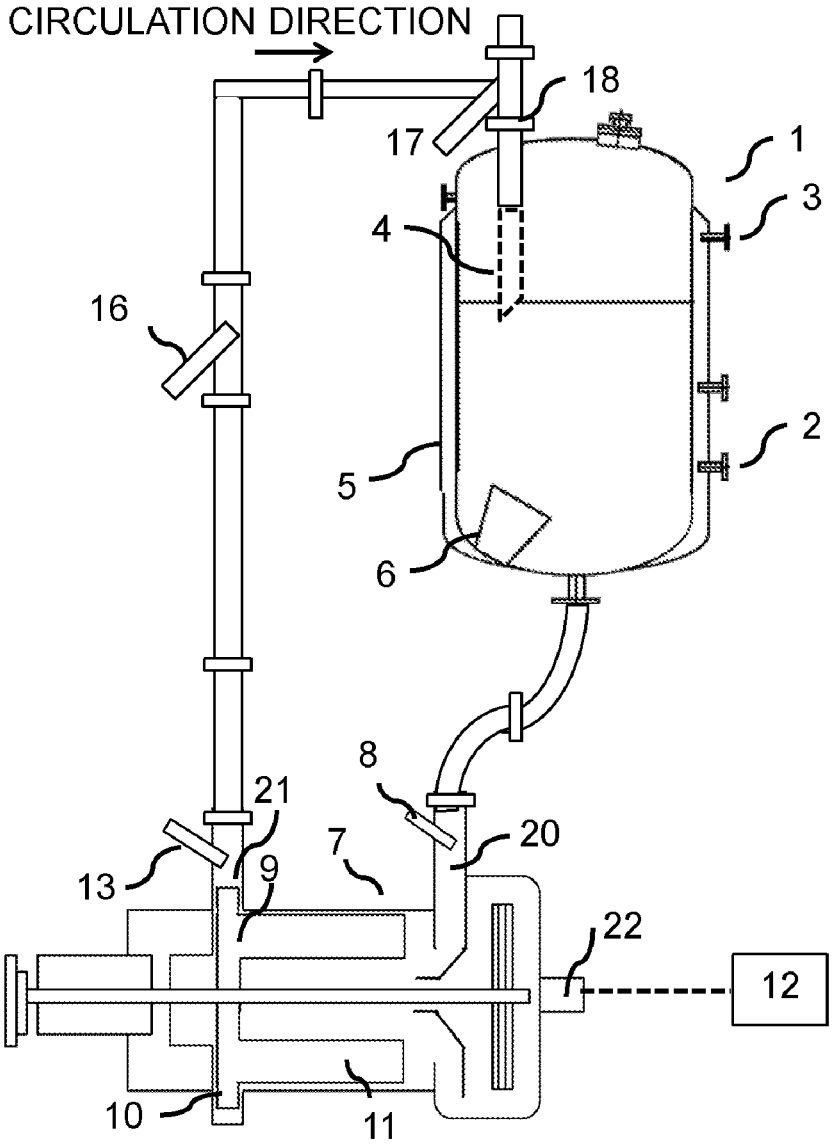
FIG. 1 is a schematic diagram showing an example of a granulation system.

Hereinafter, the present invention will be described in detail.

In the present invention, the expressions "AA or more and BB or less" and "from AA to BB" representing a numerical range mean a numerical range including a lower limit and an upper limit which are endpoints unless otherwise specified.

The toner of the present invention is a toner having a toner particle including a binder resin, a colorant, and a wax, wherein in a cross section of the toner particle observed under a scanning transmission electron microscope, a proportion of the number of toner particles having a void with a long diameter of 0.50 μm or less is 60 number % or more, preferably 65 number % or more, and even more preferably 80 number % or more. The upper limit of the proportion is not particularly limited, but it is preferably about 100 number % or less.

The numerical value ranges can be arbitrarily combined.

A proportion of the number of toner particles having a void in a region from an outline of the cross section of the toner particle inward to 1.00 μm in a total number of the toner particles having a void is 30 number % or less, preferably 20 number % or less, and even more preferably 15 number % or less. The lower limit of the proportion is not particularly limited, but it is preferably about 0 number % or more.

The numerical value ranges can be arbitrarily combined.

The inventors have considered the following reason why the toner exhibits the abovementioned effect.

When there is a large void with a long diameter of 1.00 μm or more in the cross section of a toner particle observed under a scanning transmission electron microscope, a strong stress is applied to the toner particle due to the shear occurring between functional parts during image formation. At this time, cracking and chipping of the toner particle occur at the periphery of the void as a starting point. As a result, the broken toner particle is fused to the members inside the cartridge, causing image defects.

Meanwhile, since a void with a long diameter of 0.50 μm or less is less likely to act as a cause of cracking and chipping, the void is compressed against the stress applied from the outside, thereby showing the cushioning effect and suppressing cracking and chipping.

In particular, when a void is present inside the toner particle at more than 1.00 μm from the outline of the cross section of the toner particle, it is considered that the thickness from the void to the surface of the toner particle is large, so that due to the cushioning effect, the effect of suppressing cracking and chipping is remarkably manifested.

In addition, it is preferable that the wax contained in the toner particle be encapsulated with minimal exposure on the surface of the toner particle, and quickly exude to the surface of the toner particle at the time of fixing.

Meanwhile, when the wax is present on the surface of the toner particle, contamination of the toner bearing member and contamination of the respective members such as filming on the photosensitive member may occur, which may cause deterioration in image quality.

The influence of the wax is particularly remarkable in the use under a high-temperature environment and in long-term use.

In particular, when the surface of the toner particle is chipped, the distance from the encapsulated wax to the surface of the toner particle becomes short, and exudation becomes particularly remarkable.

In the toner, there are few voids in the vicinity of the surface of the toner particle, so that defects on the surface of the toner particle can be effectively suppressed. Therefore, an effect of suppressing exudation of wax caused by surface defects of the toner particle is demonstrated.

In order to further enhance the cracking and chipping suppression effect and the wax exudation suppression effect, a proportion of the number of toner particles having a void with a long diameter of 1.00 μm or more in a cross section of the toner particle observed under a scanning transmission electron microscope is preferably 20 number % or less, and more preferably 15 number % or less. The lower limit value of the proportion is not particularly limited, but is preferably about 0 number % or more. Also, the numerical value ranges can be arbitrarily combined.

Where a large void is present inside the toner particle, when a strong stress is applied to the toner particle, the toner particle is greatly deformed which results in cracking and chipping.

In particular, when the proportion is larger than 20 number %, where the voids that did not appear in the cross section are also taken into account, it can be presumed that most of the toner particles include a void having a long diameter of 1.00 μm or more, and cracking and chipping of the toner particle is significantly influenced thereby.

Meanwhile, from the viewpoint of suppressing cracking and chipping, it is preferable that two or more voids with a long diameter of 0.50 μm or less be present in the cross section of the toner particle observed under a scanning transmission electron microscope.

When two or more voids having a long diameter of 0.50 μm or less are present, the volume capable of absorbing the impact against stress applied from the outside becomes larger.

When the number of the voids is two or more, where the voids that did not appear in the cross section are also taken into account, it can be presumed that the toner particle includes many voids having a long diameter of 0.50 μm or less.

Since a large number of voids having a long diameter of 0.50 μm or less are present in the toner particle, the cushioning effect due to the compression of the voids is further increased.

In the cross section of the toner particle observed under a scanning transmission electron microscope, where a long diameter of the void present in the cross section of the toner particle is designated by Da μm, a distance from the outline of the cross section of the toner particle to the void is designated by Db μm, and a distance from the outline of the cross section of the toner particle to the wax is designated by Dc μm, the proportion of the number of toner particles satisfying the following formulas (1) and (2) in the total number of toner particles having a void is preferably 30 number % or less, and more preferably 22 number % or less.

Although the lower limit value of the proportion is not particularly limited, it is preferably about 0 number % or more. The numerical value ranges can be arbitrarily combined.

The distance between the void and the wax is preferably 0.60 μm or less, and more preferably 0.50 μm or less.

The lower limit value of the distance is not particularly limited, but it is preferably about 0.05 μm or more. The numerical value ranges can be arbitrarily combined.

$$Da>Db \quad (1)$$

$$Da>Dc \quad (2)$$

When the formula (1) is satisfied, the distance from a void to the vicinity of the surface of the toner particle becomes short.

When a void is present inside the toner particle, the gas therein is hydrophobic so that the wax is present in close proximity to the void. Therefore, when a void is present in the vicinity of the surface of the toner particles, the wax is attracted to the void and is present in the vicinity of the surface.

Meanwhile, when the formula (2) is satisfied, the wax present in the vicinity of the void is present on the toner particle surface side while being adjacent to the void.

Therefore, when the formula (1) and the formula (2) are satisfied, the wax exudes easily.

Further, since wax also acts, similarly to a void, as a starting point of cracking and chipping, cracking and chipping of the toner particle is likely to occur.

Therefore, when the number of toner particles satisfying the formulas (1) and (2) is small, it is possible to effectively suppress deterioration in image quality and cracking and chipping of toner particles due to exudation of wax.

In addition, when the distance between the void and the wax is close to 0.60 μm or less, the stress applied to the wax can be relaxed due to the cushioning effect of the void.

Further, since the gas in the voids which is hydrophobic has a high affinity for the wax, when the wax and the void are in proximity to each other, the heat-induced movement of the wax to the surface of the toner particle can be suppressed by the attraction effect of the void.

For the above reasons, by satisfying the above conditions, it is possible to suppress the exudation of wax more effectively.

The toner production method is described hereinbelow.

A method for producing a toner, comprising a step of forming a toner particle in an aqueous medium, wherein the step of forming the toner particle has the following step (a) or step (b):

(a) a granulation step of forming a particle of a polymerizable monomer composition including a polymerizable monomer capable of forming a binder resin, a colorant, and a wax in the aqueous medium, and a polymerization step (suspension polymerization method) of forming a toner particle by polymerizing the polymerizable monomer contained in the particle of the polymerizable monomer composition after the granulation step, (b) a granulation step of dispersing a mixed solution in which a toner particle composition including a binder resin, a colorant, and a wax and an organic solvent capable of dissolving the binder resin are mixed in the aqueous medium to form a particle of the mixed solution, and a solvent removal step (dissolution and suspension method) of removing the organic solvent present in the particle of the mixed solution after the granulation step to form a toner particle, and in the granulation step in the step (a) or (b), the granulation is performed by causing circulation flow of the polymerizable monomer composition or the mixed solution and the aqueous medium in a circulation flow path provided with a device having a defoaming function and including a tank I in which a stirring means is installed.

Specific examples of the polymerizable monomer capable of forming a binder resin are presented hereinbelow.

Styrene; styrene derivatives such as α-methylstyrene, β-methylstyrene, o-methylstyrene, m-methyl styrene, p-methyl styrene, 2,4-dimethyl styrene, p-n-butyl styrene, p-tert-butyl styrene, p-n-hexyl styrene, p-n-octylstyrene, p-n-nonylstyrene, p-n-decylstyrene, p-n-dodecylstyrene, p-methoxystyrene, and p-phenylstyrene;

acrylic polymerizable monomers such as methyl acrylate, ethyl acrylate, n-propyl acrylate, iso-propyl acrylate, n-butyl acrylate, iso-butyl acrylate, tert-butyl acrylate, n-amyl acrylate, n-hexyl acrylate, 2-ethylhexyl acrylate, n-octyl acrylate, n-nonyl acrylate, cyclohexyl acrylate, benzyl acrylate, dimethyl phosphate ethyl acrylate, diethyl phosphate ethyl acrylate, dibutyl phosphate ethyl acrylate, and 2-benzoyloxyethyl acrylate; and methacrylic polymerizable monomers such as methyl methacrylate, ethyl methacrylate, n-propyl methacrylate, iso-propyl methacrylate, n-butyl methacrylate, iso-butyl methacrylate, tert-butyl methacrylate, n-amyl methacrylate, n-hexyl methacrylate, 2-ethylhexyl methacrylate, n-octyl methacrylate, n-nonyl methacrylate, diethyl phosphate ethyl methacrylate, and dibutyl phosphate ethyl methacrylate.

These polymerizable monomers can be used singly or in combination of two or more thereof.

Among these, from the viewpoint of development characteristics and durability of the toner, it is preferable to use styrene and styrene derivatives singly or in a mixture, or in a mixture with other polymerizable monomers.

The colorant can be exemplified by a known colorant suitable for toners, such as an organic pigment, an oil dye and the like. Specific examples are presented below, but the invention is not limited thereto.

Examples of the pigment suitable for a cyan colorant include copper phthalocyanine compounds and derivatives thereof, anthraquinone compounds, and basic dye lake compounds.

Specifically, the following can be mentioned.

C. I. Pigment Blue 15, C. I. Pigment Blue 15:1, C. I. Pigment Blue 15:2, C. I. Pigment Blue 15:3 and C. I. Pigment Blue 15:4.

Examples of the pigment suitable for a magenta colorant include condensed azo compounds, diketopyrrolopyrrole compounds, anthraquinone compounds, quinacridone compounds, basic dye lake compounds, naphthol compounds, benzimidazolone compounds, thioindigo compounds and perylene compounds.

Specifically, the following can be mentioned.

C. I. Pigment Violet 19, C. I. Pigment Red 31, C. I. Pigment Red 122, C. I. Pigment Red 150, and C. I. Pigment Red 269.

Examples of the pigment suitable for a yellow colorant include condensed azo compounds, isoindolinone compounds, anthraquinone compounds, azo metal complexes, methine compounds, and allyl amide compounds.

Specifically, the following can be mentioned.

C. I. Pigment Yellow 74, C. I. Pigment Yellow 93, C. I. Pigment Yellow 120, C. I. Pigment Yellow 151, C. I. Pigment Yellow 155, C. I. Pigment Yellow 180, and C. I. Pigment Yellow 185.

Examples of the black colorant include carbon black, magnetic bodies, and colorants toned in black using the abovementioned yellow, magenta and cyan colorants.

The amount of the colorant is preferably from 1 part by mass to 20 parts by mass with respect to 100 parts by mass of the polymerizable monomer capable of forming a binder resin or the binder resin.

The following known waxes can be used as the wax.

Polymethylene waxes such as paraffin wax, polyolefin wax, microcrystalline wax and Fischer-Tropsch wax;

petroleum waxes and derivatives thereof such as amide wax, petrolatum and the like; natural waxes and derivatives thereof such as montan wax, carnauba wax, candelilla wax and the like, hydrogenated castor oil and derivatives thereof;

vegetable waxes, animal waxes, higher fatty acid, long-chain alcohols, ester waxes, ketone waxes and derivatives thereof such as graft compounds or block compounds.

These can be used singly or in combination of two or more thereof.

At least one of the waxes preferably has a melting point (a temperature corresponding to a maximum endothermic peak of an endothermic curve in a temperature range of 20° C. to 200° C. as measured by a differential scanning calorimeter) of from 30° C. to 120° C., and more preferably from 50° C. to 100° C.

Further, it is preferable that the wax be a solid wax at room temperature, and in particular, a solid wax having a melting point of from 50° C. to 100° C. is preferable from the viewpoints of toner blocking resistance, multisheet durability, low-temperature fixability and offset resistance.

The amount of the wax is preferably from 3 parts by mass to 30 parts by mass, more preferably from 3 parts by mass to 20 parts by mass, and even more preferably from 4 parts by mass to 15 parts by mass with respect to 100 parts by mass of the polymerizable monomer capable of forming a binder resin or the binder resin.

When the amount of the wax is equal to or higher than the lower limit value, the offset preventing effect is hardly lowered. Meanwhile, when the amount of the wax is equal to or lower than the upper limit value, the blocking resistance effect does not deteriorate, the offset resistance effect is hardly adversely affected, and the toner is unlikely to fuse to a drum or a developing sleeve.

When a hydrocarbon wax is used as the wax, even better blocking resistance effect and offset resistance effect are obtained and the toner is less likely to fuse to the toner layer thickness control member or the toner bearing member.

In the case where it is necessary to extract the wax from the toner in order to obtain the physical properties such as described hereinabove, the extraction method is not particularly limited, and any method can be used.

For example, a predetermined amount of toner is Soxhlet extracted with toluene, the solvent is removed from the toluene solubles thus obtained, and chloroform insolubles are then obtained. After that, quantitative analysis is performed by an IR method or the like.

Regarding the quantitative determination and physical properties, the measurement may be carried out using a differential scanning calorimeter "Q1000" (manufactured by TA Instruments).

The intersection of a differential thermal curve and a line at the midpoint of a baseline before and after the change in specific heat at the time of measurement is taken as a glass transition temperature. In addition, the peak temperature (melting point) of the maximum endothermic peak of wax is obtained from a DSC curve at the time of temperature rise obtained.

A charge control agent may be blended (internally added) or mixed (externally added) with the toner particle in order to control the charge amount of the toner particle to a desired value.

A known charge control agent can be used.

For example, agents that control the toner particles to be negatively chargeable are presented hereinbelow.

Organometallic compounds and chelate compounds are effective, examples thereof including monoazo dye metal compounds and acetylacetone metal compounds; aromatic hydroxycarboxylic acids, aromatic mono- and polycarboxylic acids and metal salts thereof, anhydrides thereof or esters thereof phenol derivatives such as bisphenol and the like.

Further, the following compounds can be mentioned. Urea derivatives, metal-containing salicylic acid compounds, calixarene, silicon compounds, styrene-acrylic acid copolymers, styrene-methacrylic acid copolymers, sulfonic acid group-containing resins such as styrene-acryl-sulfonic acid copolymers and the like, and non-metal carboxylic acid compounds.

Meanwhile, agents that control the toner particles to be positively chargeable are presented hereinbelow.

Nigrosine and products of modification thereof with a fatty acid metal salt; quaternary ammonium salts such as tributylbenzylammonium-1-hydroxy-4-naphthosulfonate and tetrabutylammonium tetrafluoroborate; onium salts such as phosphonium salts and lake pigments thereof, triphenylmethane dyes and lake pigments thereof (laking agents are exemplified by phosphotungstic acid, phosphomolybdic acid, phosphotungstomolybdic acid, tannic acids, lauric acid, gallic acid, ferricyanides and ferrocyanides), and metal salts of higher fatty acids; diorganotin oxides such as dibutyltin oxide, dioctyltin oxide, dicyclohexyltin oxide, and the like; and diorganotin borates such as dibutyltin borate, dioctyltin borate, and dicyclohexyltin borate.

These charge control agents can be used singly or in combination of two or more thereof.

The amount of the charge control agent is preferably from 0.01 parts by mass to 20 parts by mass and more preferably from 0.5 parts by mass to 10 parts by mass with respect to 100 parts by mass of the polymerizable monomer capable of forming a binder resin or the binder resin.

In the polymerization step, a polymerization initiator may be used. Examples of the polymerization initiator include azo polymerization initiators and organic peroxide initiators.

Examples of the azo type polymerization initiator are presented hereinbelow.

2,2'-Azobis (2,4-dimethylvaleronitrile), 2,2'-azobisisobutyronitrile, 1,1'-azobis (cyclohexane-1-carbonitrile), 2,2'-azobis-4-methoxy-2,4-dimethylvaleronitrile, and azobismethylbutyronitrile.

Examples of the organic peroxide initiator are presented hereinbelow.

Benzoyl peroxide, methyl ethyl ketone peroxide, diisopropyl peroxycarbonate, cumene hydroperoxide, 2,4-dichlorobenzoyl peroxide, lauroyl peroxide, and tert-butyl peroxypivalate.

It is also possible to use a redox-type initiator combining an oxidizing substance and a reducing substance. Examples of the oxidizing substance include inorganic peroxides such as hydrogen peroxide, persulfates (sodium salt, potassium salt, ammonium salt and the like) and oxidizing metal salts such as tetravalent cerium salts.

Examples of the reducing substance include reducing metal salts (divalent iron salts, monovalent copper salts, and trivalent chromium salts), ammonia, lower amines (amines having 1 to 6 carbon atoms such as methylamine and ethylamine), amino compounds such as hydroxylamine, a reducing sulfur compound such as sodium thiosulfate, sodium hydrosulfite, sodium bisulfite, sodium sulfite, and sodium formaldehyde sulfoxylate, lower alcohols (1 to 6 carbon atoms), ascorbic acid or salts thereof, and lower aldehydes thereof (1 to 6 carbon atoms).

The polymerization initiator is selected with reference to a 10-hour half-life temperature, and is used singly or as a mixture.

The addition amount of the polymerization initiator is generally from about 0.5 parts by mass to about 20 parts by mass with respect to 100 parts by mass of the polymerizable monomer.

Various crosslinking agents can also be used. Examples of the crosslinking agents are presented hereinbelow.

Divinylbenzene, 4,4'-divinylbiphenyl, hexanediol diacrylate, ethylene glycol di(meth)acrylate, diethylene glycol di(meth)acrylate, glycidyl (meth)acrylate, and trimethylolpropane tri(meth)acrylate.

The binder resin is not particularly limited and may be appropriately selected from known ones. Further, a binder resin obtained by polymerizing the above polymerizable monomers can be used.

Specific examples thereof include homopolymers or copolymers of styrenes such as styrene, chlorostyrene and the like; monoolefins such as ethylene, propylene, butylene, isoprene and the like; vinyl esters such as vinyl acetate, vinyl propionate, vinyl benzoate, vinyl butyrate and the like; a-methylene aliphatic monocarboxylic acid esters such as methyl acrylate, ethyl acrylate, butyl acrylate, dodecyl acrylate, octyl acrylate, phenyl acrylate, methyl methacrylate, ethyl methacrylate, butyl methacrylate, dodecyl methacrylate and the like; vinyl ethers such as vinyl methyl ether, vinyl ethyl ether, vinyl butyl ether and the like; vinyl ketones such as vinyl methyl ketone, vinyl hexyl ketone, vinyl isopropenyl ketone and the like.

Examples of polymers of styrene or substitution products thereof include polystyrene, poly-p-chlorostyrene, polyvinyl toluene and the like.

Examples of the styrene copolymers include styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-a-chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer, styrene-maleic acid ester copolymers and the like.

Representative binder resins include polystyrene resins, polyester resins, styrene-alkyl acrylate copolymers, styrene-alkyl methacrylate copolymers, styrene-acrylonitrile copolymer, styrene-butadiene copolymer, styrene-maleic anhydride copolymer, polyethylene resins, polypropylene resins and the like. These resins may be used singly, or two or more thereof may be used in combination.

The organic solvent is not particularly limited as long as the binder resin can be dissolved thereby, but from the viewpoint of facilitating subsequent removal of the solvent, it is preferable that the organic solvent be volatile with a boiling point lower than 100° C.

Examples of the organic solvent are presented hereinbelow. These solvents can be used singly or in combination of two or more thereof.

Toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone, methyl isobutyl ketone and the like.

When the resin to be dissolved or dispersed in the organic solvent has a polyester skeleton, from the viewpoint of solubility of the resin, an ester type solvent such as methyl acetate, ethyl acetate, butyl acetate or the like, or a ketone type solvent such as methyl ethyl ketone, methyl isobutyl ketone and the like is preferable.

From the viewpoint of solvent removability, methyl acetate, ethyl acetate, and methyl ethyl ketone are more preferable.

In the dissolution and suspension method, a modified resin (hereinafter sometimes referred to as "prepolymer") may be used. The modified resin is not particularly limited as long as the modified resin has at least a site capable of reacting with an active hydrogen group-containing compound, and the modified resin can be appropriately selected from known resins and the like. Specific examples include polyol resins, polyacrylic resins, polyester resins, epoxy resins, and derivative resins thereof.

These may be used singly, or two or more thereof may be used in combination.

Among them, a polyester resin is preferable from the viewpoint of high fluidity at the time of melting and transparency.

The site capable of reacting with the active hydrogen group-containing compound in the prepolymer is not particularly limited and can be appropriately selected from known substituents and the like. Specific examples include an isocyanate group, an epoxy group, a carboxy group, an acid chloride group, and the like.

These may be contained singly or in combination of two or more thereof. Of these, an isocyanate group is preferred.

The active hydrogen group-containing compound acts as an elongating agent, a crosslinking agent and the like when the modified resin capable of reacting with the active hydrogen group-containing compound undergoes an elongation reaction, a crosslinking reaction and the like in an aqueous medium.

The active hydrogen group-containing compound is not particularly limited as long as the compound has an active hydrogen group, and the active hydrogen group-containing compound can be appropriately selected according to the purpose. In a specific example, when the polymer capable of reacting with the active hydrogen group-containing compound is an isocyanate group-containing polyester prepolymer, amines are preferable from the viewpoint of enabling an increase in molecular weight by an elongation reaction, a crosslinking reaction and the like with the isocyanate group-containing polyester prepolymer.

The active hydrogen group is not particularly limited and may be appropriately selected depending on the purpose. Specific examples include a hydroxyl group (alcoholic hydroxyl group or phenolic hydroxyl group), an amino group, a carboxy group, a mercapto group and the like. These may be used singly, or two or more thereof may be used in combination. Among them, an alcoholic hydroxyl group is preferable.

An external additive may be added to the toner for the purpose of improving various powder characteristics.

Examples of the external additive are presented hereinbelow.

Metal oxides such as aluminum oxide, titanium oxide, strontium titanate, cerium oxide, magnesium oxide, chromium oxide, tin oxide, and zinc oxide; nitrides such as silicon nitride; carbides such as silicon carbide; inorganic metal salts such as calcium sulfate, barium sulfate and calcium carbonate; fatty acid metal salts such as zinc stearate and calcium stearate; carbon black, and silica.

The amount of the external additive is preferably from 0.01 parts by mass to 10 parts by mass and more preferably from 0.05 parts by mass to 5 parts by mass with respect to 100 parts by mass of the toner particles. The external additives may be used singly or in combination. Further, it is more preferable that these external additives be hydrophobized.

The toner particle may be a magnetic toner particle including a magnetic body.

The magnetic body contained in the toner particle can also serve as a colorant. Examples of the magnetic body are presented hereinbelow.

Iron oxide such as magnetite, hematite, and ferrite; metals such as iron, cobalt, and nickel or alloys of these metals with aluminum, cobalt, copper, lead, magnesium, tin, zinc, antimony, beryllium, bismuth, cadmium, calcium, manganese, selenium, titanium, tungsten, and vanadium, and mixtures thereof.

The amount of the magnetic body is preferably from 20 parts by mass to 200 parts by mass and more preferably from 40 parts by mass to 100 parts by mass with respect to 100 parts by mass of the polymerizable monomer capable of forming a binder resin or the binder resin.

When a magnetic body is used, it is preferable to hydrophobize the surface of the magnetic body in order to improve the dispersibility of the magnetic body in the toner particle.

For the hydrophobic treatment, a coupling agent such as a silane coupling agent and a titanium coupling agent may be used.

Among these, a silane coupling agent is preferable.

Examples of the silane coupling agent are presented hereinbelow.

Vinyltrimethoxysilane, vinyltriethoxysilane, γ-methacryloxypropyltrimethoxysilane, vinyltriacetoxysilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-hexadecyltrimethoxysilane, and n-octadecyltrimethoxysilane.

The step (a) will be described in detail hereinbelow, but this description is not limiting.

Preparation of Polymerizable Monomer Composition

A polymerizable monomer composition including a polymerizable monomer capable of forming a binder resin, a colorant, and a wax is prepared. The colorant may be dispersed in advance in a part of the polymerizable monomer and then mixed with the remaining polymerizable monomer or the like. Alternatively, all of the components may be mixed at the same time to prepare a polymerizable monomer composition.

Granulation Step

The polymerizable monomer composition is charged into an aqueous medium including a surfactant or inorganic fine particles hardly soluble in water and dispersed to form particles of the polymerizable monomer composition in the aqueous medium. A dispersion including particles of the polymerizable monomer composition is thereby obtained.

In the production method, by providing a device having a defoaming function in a circulation flow path, it is possible to control the size and position of a void in the toner particle having the void and to suppress cracking and chipping.

Specifically, in the granulation step of forming the particles of the polymerizable monomer composition in an aqueous medium, granulation is carried out by causing circulation flow of the polymerizable monomer composition and the aqueous medium through a circulation flow path which is provided with a device 7 having a defoaming function and includes a tank I (1 in the figure) in which a stirring means is installed.

FIG. 1 is a schematic diagram showing an example of a granulation system used in the production method, but the present invention is not limited thereto.

The circulation flow path is connected to the tank I. In the circulation flow path, the device 7 having a defoaming function (hereinafter also simply referred to as a device 7) and optionally auxiliary devices (not shown) such as a pressure gauge, a thermometer, a flow meter and the like are installed.

In the system including the device 7 having a defoaming function, the polymerizable monomer composition and the aqueous medium are charged into the tank I.

Thereafter, a granulation treatment liquid is prepared by dispersing and mixing for a predetermined time with a stirring means 6 of the tank I. In order to adjust the temperature of the mixed liquid in the tank I, temperature-controlled water may be introduced into a jacket 5 via a jacket inlet 2 and a jacket outlet 3.

Particles of the polymerizable monomer composition are formed by performing the granulation treatment for a predetermined time.

The device 7 shown in FIG. 1 has a function of feeding the aqueous medium including a polymerizable monomer composition in the circulation flow path and has a function of extracting air bubbles contained in the aqueous medium.

When extracting bubbles contained in the aqueous medium, bubbles contained in the particles of the polymerizable monomer composition are also removed.

This defoaming action is strongly demonstrated in the vicinity of the surface of the toner particle (specifically, within 1.00 μm from the surface), and since larger air bubbles have a smaller surface tension and are more likely to collapse, the defoaming action in the case of large bubbles is strong.

As a result, even in the toner particles obtained by polymerizing the particles of the polymerizable monomer composition, voids in the vicinity of the surface and large voids are reduced.

Such an action is not limited to the suspension polymerization method and can be applied to a production method in which granulation is carried out in an aqueous medium, such as a dissolution suspension method.

Further, since the device 7 has a function of extracting bubbles, the area of defoaming action related to the volume of the liquid to be defoamed is increased. Therefore, the defoaming effect is higher than that in the tank I where the bubbles caught in the liquid cannot be uniformly and efficiently removed from the entire liquid.

Therefore, the toner particle obtained by the production method has few voids in the vicinity of the surface, and the size of the voids is small. Therefore, this method is effective in suppressing cracking and chipping.

The device having a defoaming function is not particularly limited, and examples thereof include general devices such as an air ejector type deaerator, a piston/cylinder type or a centrifugal fan type decompression pump and the like.

Further, where a large amount of bubbles are contained in the aqueous medium, the collision energy created by the stirring means is unlikely be efficiently given to the aqueous medium. When the amount of bubbles in the aqueous medium is small, the granulation efficiency is increased, the particle size distribution is improved, and productivity is also improved since short processing can be performed.

In addition, since generation of foam is suppressed, adjustment of shearing conditions such as reduction of stirring speed becomes unnecessary, and a high shearing force can be maintained.

For the reasons described above, the size and amount of voids inside the toner particle can be controlled by the production method, and toner particles with good particle size distribution and high resistance to cracking and chipping can be formed.

A vertical stirring tank equipped with a stirring means having a high shear force can be used as the tank I. Commercially available products such as ULTRA-TURRAX (manufactured by IKA), T. K. HOMOMIXER (manufactured by Primix Corporation), T. K. FILMIX (manufactured by Primix Corporation), CLEARMIX (manufactured by M Technique Co., Ltd.), CAVIMIX (manufactured by Pacific Machinery & Engineering Co., Ltd.), COLOID MILL (manufactured by IKA), CAVITRON (manufactured by Eurotec Co., Ltd.), and W MOTION (manufactured by M Technique Co., Ltd.) can be used as the stirring means having a high shearing force.

When the peripheral velocity (peripheral velocity of the rotor in the case of rotor and stator type) of a stirring blade of the stirring means (6 and 15 in the figure) installed in the tank I and a tank II (14 in the figure) to be described later is 25 m/s or more, the shearing force of the stirring blade increases. Accordingly, the particle size distribution is found to be improved and bubbles are more likely to be generated in the aqueous medium, so that the effect of the present invention becomes remarkable.

Since bubbles generated at this time are caused by cavitation, small bubbles are generated preferentially. When the peripheral velocity is less than 75 m/s, since heat generation due to stirring can be suppressed, it is possible to prevent thermal polymerization of the polymerizable monomer from progressing with time due to heat generation and to prevent conversion to a polymer. As a result, toner particles having a sharp particle size distribution of the obtained toner particles can be obtained. From the viewpoint of the durability of the device as a production device, it is also appropriate to reduce the peripheral velocity below 75 m/s.

The stirring means installed in the tank I and the tank II to be described later is provided with, in an agitator such as CLEARMIX (manufactured by M Technique Co., Ltd.) and W MOTION (manufactured by M Technique Co., Ltd.), a stirring chamber formed by a stirring rotor rotating at high speed and a screen provided so as to surround the stirring rotor.

In the case of CLEARMIX (manufactured by M Technique Co., Ltd.) and W MOTION (manufactured by M Technique Co., Ltd.), the slits of the screen are formed so as to penetrate the inner and outer walls of the screen. The width of the slit means the width of the slit in the rotation direction of the rotor.

In the case of CAVITRON (manufactured by Eurotec Co., Ltd.), the slits are engraved in a stator opposed to the outermost diameter portion of the stirring rotor as a rotating element, and the slit width means the width of the slit in the rotation direction of the rotor.

The larger the slit width, the larger the bubbles generated, and the smaller the slit width, the smaller the bubbles generated. This is thought to be because the smaller slit width results in a smaller negative pressure portion which becomes the source of cavitation. This is also thought to be because the smaller slit width results in a larger number of shearing points acting on the bubbles in the aqueous medium, and the bubbles are sheared more finely.

In the case of CLEARMIX (manufactured by M Technique Co., Ltd.) and W MOTION (manufactured by M Technique Co., Ltd.), the slit width is preferably from 3 mm to 10 mm.

Meanwhile, in the case of CAVITRON, the slit width is preferably from 0.3 mm to 3.0 mm.

With the slit width smaller than the upper limit of the above range, the number of shearing points acting on the aqueous medium increases and the particle size distribution becomes sharp.

With the slit width larger than the lower limit of the above range, since the negative pressure portion accompanying the rotation of the rotor is not excessively increased, the risk of damage to the rotor and the slit accompanying the occurrence of cavitation is reduced.

As the circulation flow rate increases, the amount of the aqueous medium including the polymerizable monomer composition which passes through the device 7 per unit time increases, so that it is possible to defoam the liquid in the tank I in a shorter time. However, since the speed of reintroduction into the tank I is increased, foaming at the time of returning to the tank I increases. Since the bubbles generated at this time are larger in size than the bubbles generated by the stirring means, the effect of the present invention acting on the large bubbles is more remarkably exhibited.

When the above-described granulation system is assembled, it is preferable to provide the tank II (14 in the drawing) equipped with the stirring means 15 in the circulation flow path.

Figure 2:
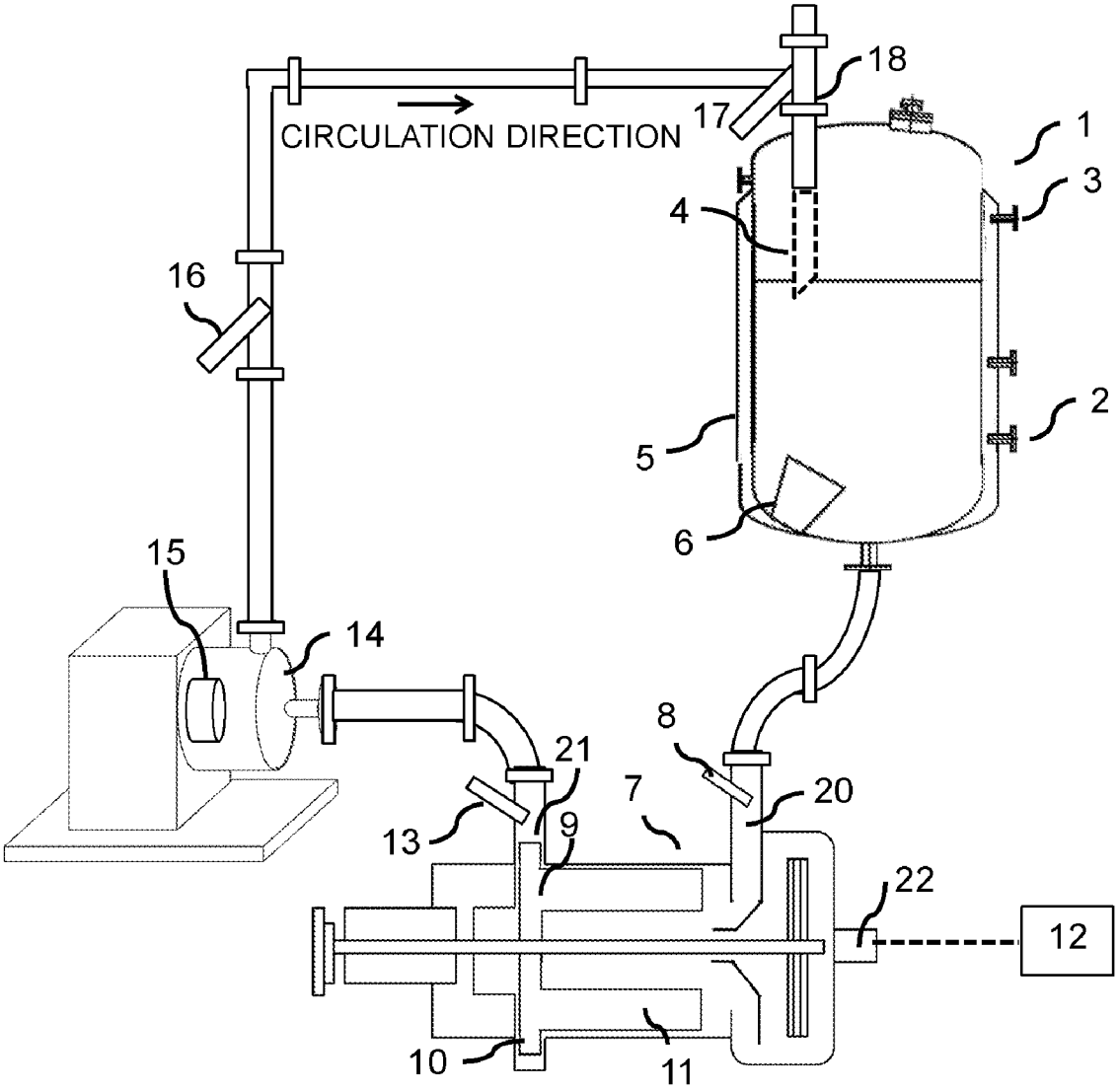
FIG. 2 is a schematic diagram showing an example of a granulation system.

FIG. 2 is also a schematic diagram showing one example of a granulation system used in the production method, but the present invention is not limited thereto.

Specifically, the circulation flow path is connected to the tank I, and in the circulation flow path, the device 7 having a defoaming function, the tank II equipped with the stirring means 15, and optionally auxiliary devices (not shown) such as a pressure gauge, a thermometer, a flow meter and the like are installed.

In the system including the device 7 having a defoaming function, the polymerizable monomer composition and the aqueous medium are charged into the tank I.

Thereafter, a pre-granulation step may be carried out in which the mixed liquid is obtained by dispersing or mixing for a predetermined period of time with the stirring means 6 of the tank I. In order to adjust the temperature of the mixed liquid in the tank I, temperature-controlled water may be introduced into the jacket 5 via the jacket inlet 2 and the jacket outlet 3.

The obtained mixed liquid is supplied to the tank II via the device 7, and granulation treatment is performed by the stirring means 15 of the tank II to prepare a granulation treatment liquid. Thereafter, the obtained granulation treatment liquid is returned to the tank I.

The granulation treatment liquid returned to the tank I is supplied to the tank II again by the device 7.

Then, granulation treatment is performed uniformly and efficiently while repeating circulation between the tank I and the tank II, and particles of the polymerizable monomer composition are formed by carrying out the granulation treatment for a predetermined time.

The device 7 shown in FIG. 2 has a function of feeding the aqueous medium including the polymerizable monomer composition in the tank I to the tank II and has a function of extracting air bubbles contained in the aqueous medium.

A device having the defoaming function is not particularly limited, and examples thereof include general devices such as an air ejector type deaerator, a piston/cylinder type or a centrifugal fan type decompression pump and the like.

A vertical stirring tank equipped with a stirring means having a high shear force can be used as the tank I and tank II. Commercially available products such as ULTRA-TURRAX (manufactured by IKA), T. K. HOMOMIXER (manufactured by Primix Corporation), T. K. FILMIX (manufactured by Primix Corporation), CLEARMIX (manufactured by M Technique Co., Ltd.), CAVIMIX (manufactured by Pacific Machinery & Engineering Co., Ltd.), COLOID MILL (manufactured by IKA), CAVITRON (manufactured by Eurotec Co., Ltd.), and W MOTION (manufactured by M Technique Co., Ltd.) can be used as the stirring means having a high shearing force.

In the production method based on batch operation, a granulation step is carried out by using the stirring means installed in the tank I to form particles of the polymerizable monomer composition.

In this case, bubbles are slightly mixed into the aqueous medium. In view of the particle size distribution of the toner particles, it is necessary to maintain the satisfactory circulation of the entire liquid while applying a shearing force to the particles of the polymerizable monomer composition. However, according to this method, it is difficult to exert a uniform shearing force to the entire aqueous medium including the particles of the polymerizable monomer composition, and the particle size distribution of the obtained toner particles is widened. Also, with batch operation alone, from the viewpoint of entrainment of foam and the like, it is difficult to impart high shear, and generation of cavitation is small. Therefore, it becomes difficult to include small voids in the toner particles.

Meanwhile, in the continuous operation (circulation granulation method), circulation granulation is carried out in which the polymerizable monomer composition is dispersed in the aqueous medium in a granulation container equipped with a general stirring means, and a part of this dispersion is thereafter extracted, passed through an external tank equipped with a high-shear stirring means provided outside the granulation container, and returned to the granulation container.

In this case, since the satisfactory circulation of the entire liquid can be maintained, a uniform shearing force can be exerted to the entire aqueous medium including the particles of the polymerizable monomer composition.

As a result, the particle size distribution of the obtained toner particles becomes sharp.

In addition, since the system is uniform, small voids effective for suppressing cracking and chipping are uniformly taken into each toner particle. As a result, it becomes possible to control the number of toner particles having voids with a long diameter of 0.50 μm or less to an appropriate state, and production of toner particles having low resistance to cracking and chipping is suppressed.

Usually, when the circulation granulation method is used, bubbles are likely to be generated due to foaming at the time of returning from the circulation flow path to the tank I and cavitation in the high-shear stirrer.

The generated bubbles are taken into the particles of the polymerizable monomer composition during granulation, whereby toner particles having a large number of voids therein are likely to be formed.

The voids are taken in random positions in the toner particle, and there are cases where many voids are present in the vicinity of the surface. Such toner particle tends to be cracked and chipped under the effect of external stress.

Meanwhile, in the production method, by using a device having a defoaming function in the circulation flow path, it is possible to remove preferentially the voids on the surface of the toner particle and large voids. Therefore, it is possible to control the size and position of the voids in a state with a sharp particle size distribution, and cracking and chipping can be suppressed.

Figure 3:
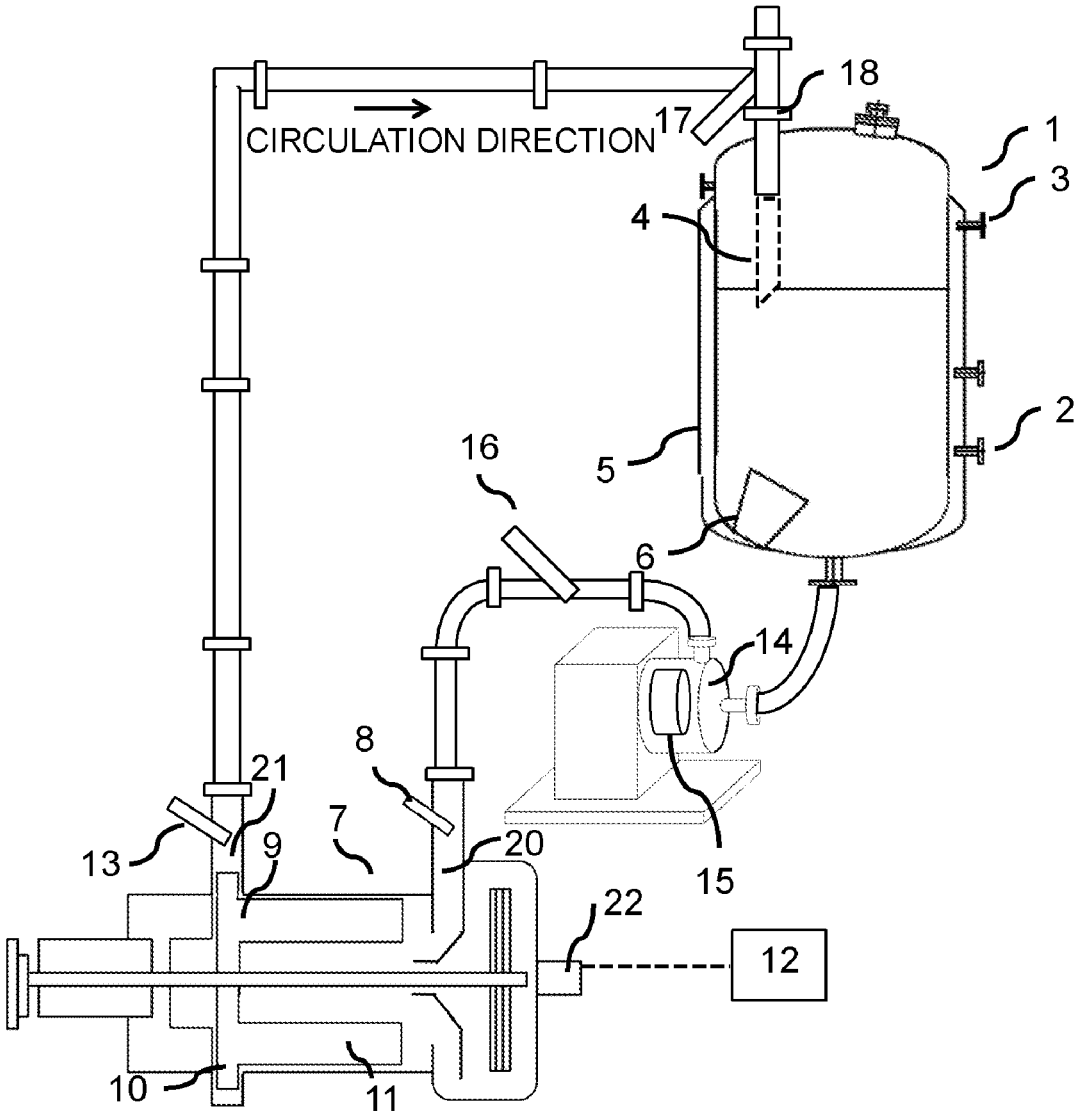
FIG. 3 is a schematic diagram showing an example of a granulation system.

The tank I, the tank II, and the device 7 having a defoaming function may be arranged in the order of the tank I, the device 7, and the tank II on the circulation flow path as shown in FIG. 2, or in the order of the tank I, the tank II, and the device 7 as shown in FIG. 3.

When assembling the granulation system, the tank I has an inner nozzle 4 connected to the circulation flow path, and it is preferable that the circulation be carried out in a state in which the discharge port of the inner nozzle 4 is present below the liquid surface in the tank I.

Where the discharge port of the inner nozzle 4 is present below the liquid level in the tank I, it is possible to suppress the entrainment of air when the aqueous medium including particles of the polymerizable monomer composition circulates and returns to the tank I again.

The device 7 having the defoaming function is not particularly limited as long as the device can remove air bubbles or gas transported together with the liquid when the liquid is fed, but a device having the following structure and mechanism is preferably used.

The device 7 having a defoaming function has a casing and an impeller 9 provided in the casing, and a discharge blade 10 is formed at one axial end portion of the impeller 9.

A fluid discharge port 21 is provided in a casing portion opposite to the discharge blade 10, and an inducer 11 is formed, so as to slide relative to the inner wall of the casing, at the other axial end portion of the impeller 9.

An exhaust port 22 is provided in the casing portion opposite to the sliding inducer 11, and the exhaust port 22 is communicated with a degassing device 12.

A device is preferred in which a fluid suction port 20 is provided between the fluid discharge port 21 and the exhaust port 22 of the casing and gas-liquid separation is performed by the centrifugal force of the inducer 11 of the impeller 9.

In the device, gas-liquid separation by the centrifugal force of the inducer 11 of the impeller 9 is carried out after adjusting the suction flow rate and the discharge flow rate with a suction valve 8 and a discharge valve 13 so that the inside of the casing is not fully filled with the liquid. The degassing device 12 is thereafter operated to remove bubbles or gas located in the aqueous medium and the particles of the polymerizable monomer composition.

By performing gas-liquid separation by the centrifugal force of the inducer 11 of the impeller 9, it is possible to expose the gas-liquid boundary surface to a high vacuum in a wide range and to efficiently remove the bubbles located in the aqueous medium and the particles of the polymerizable monomer composition. In addition, since the centrifugal force in the direction opposite to the suction direction acts at all times on the aqueous medium including the particles of the polymerizable monomer composition, degassing can be effectively performed without a drop in yield even when the viscosity of the aqueous medium is low. The reference numeral 16 in the figure stands for a back pressure valve, 17 for a three-way valve, and 18 for a circulating liquid return port.

The centrifugal force of the outermost periphery of the separating blade of the impeller 9 for separating gas and liquid in the device 7 having a defoaming function is preferably 50 G or more and more preferably from 200 G to 800 G.

In the case where the centrifugal force is 200 G or more, gas-liquid separation can be performed more effectively, defoaming can be sufficiently performed, and voids are less likely to be included in the surface of the particles of the polymerizable monomer composition.

Meanwhile, when the centrifugal force is 800 G or less, it is possible to suppress the collapse of the granulation balance due to the shearing by the impeller and fusion of the particles of the polymerizable monomer composition caused by the pressure applied between the particles by the centrifugal force, and a sharp particle size distribution can be easily maintained.

By adjusting the centrifugal force within the above range, it becomes easy to adjust the number of the toner particles having a void with a long diameter of 0.50 μm or less and to control the state of presence of voids within the range of the present invention.

Preparation of Aqueous Medium

The composition of the aqueous medium is not particularly limited, and a known aqueous medium mainly using water may be used.

From the viewpoint of improving the dispersion stability of the particles of the polymerizable monomer composition, it is preferable that the aqueous medium include a dispersion stabilizer. The dispersion stabilizer can be exemplified by the following inorganic fine particles having poor solubility in water, but this list is not limiting.

Carbonates such as barium carbonate, calcium carbonate, magnesium carbonate and the like;

metal phosphates such as aluminum phosphate, magnesium phosphate, calcium phosphate, barium phosphate, zinc phosphate and the like;

sulfates such as barium sulfate, calcium sulfate and the like;

metal hydroxides such as calcium hydroxide, aluminum hydroxide, magnesium hydroxide, and ferric hydroxide;

These can be used singly or in combination of two or more thereof.

When the above-mentioned compounds are present as fine particles in an aqueous medium, they function as a dispersion stabilizer.

Polymerization Step

After the above granulation step, the polymerizable monomer contained in the obtained particle of the polymerizable monomer composition is polymerized to form a toner particle.

In the polymerization step, the polymerization initiator described above may be added.

In the polymerization step, a reaction tank having general stirring means capable of controlling the temperature may be used.

The polymerization temperature is 40° C. or more, generally 50° C. to 90° C. Although the polymerization temperature may be constant from the beginning, the temperature may be raised in the latter half of the polymerization step for the purpose of obtaining a desired molecular weight distribution.

The stirring blade used for the stirring means may be of any kind as long as the particles of the polymerizable monomer composition can be suspended without accumulation and the temperature in the tank can be kept uniform.

Typical stirring blades such as paddle blades, inclined paddle blades, three retracting blades, propeller blades, disk turbine blades, helical ribbon blades and anchor blades can be exemplified as the stirring blade or stirring means.

In addition, "FULL ZONE" (manufactured by Shinko Environmental Solutions, Ltd.), "TWIN STAR" (manufactured by Shinko Environmental Solutions, Ltd.), "MAX BLEND" (manufactured by Sumitomo Heavy Industries, Ltd.), "SUPER MIX" (manufactured by Satake Chemical Equipment Mgf., Ltd.), and "Hi-F MIXER" (manufactured by Soken Chemical & Engineering Co., Ltd.) may be used.

Distillation Step

After the polymerization step, a part of the aqueous medium may be distilled off, if necessary, by distillation after completion of the polymerization in order to remove volatile impurities such as unreacted polymerizable monomer and byproducts. The distillation step can be carried out at normal pressure or under reduced pressure.

Cooling Treatment Step

It is preferable that the following steps be included:

a step (c) of setting the temperature of the toner particle formed through the polymerization step to a temperature Ta (° C.) higher than the higher one of the crystallization temperature Tc (° C.) of the wax and the glass transition temperature Tg (° C.) of the toner particle, and a step (d) of cooling from the temperature Ta (° C.) to a temperature equal to or lower than the Tg (° C.) at a cooling rate of 20° C./min or more.

The step (c) and the step (d) may be carried out in the state of a dispersion in which the toner particles obtained in the step (a) are dispersed in an aqueous medium.

Further, the step (c) and the step (d) may be carried out in the state of a dispersion in which the toner particles are dispersed in an aqueous medium, the dispersion being obtained by washing, filtering, and drying the toner particles obtained in the step (a), and then dispersing the particles again in the aqueous medium.

Further, where the polymerization temperature in the step (a) exceeds the higher one of the crystallization temperature Tc (° C.) of the wax and the glass transition temperature Tg (° C.) of the toner particles, it can be assumed that the step (c) has been implemented.

Specifically, the temperature of the dispersion in which the toner particles are dispersed in the aqueous medium is raised to a temperature Ta (° C.) higher than the higher one of the crystallization temperature Tc (° C.) of the wax and the glass transition temperature Tg (° C.) of the toner particles (step (c)).

Thereafter, cooling is performed from the temperature Ta (° C.) to the temperature equal to or lower than the Tg (° C.) at the abovementioned cooling rate (step (d)).

Here, the temperature just before the dispersion is cooled is taken as a cooling start temperature T1.

Thereafter, the temperature just after completing the cooling of the dispersion is taken as a cooling stop temperature T2.

At this time, the cooling rate is calculated by the following equation.

$$\text{Cooling rate}=[T1(^\circ\text{ C.})-T2(^\circ\text{ C.})]/[\text{time required for cooling}](\text{min})$$

When cooling is carried out from a high temperature at which the binder resin and the wax can be melted uniformly to a temperature close to the glass transition temperature of the toner particles at a gentle cooling rate, the wax is unevenly distributed in the toner particle.

Among such toner particles, there are particles in which wax is unevenly distributed near the surface of the toner particle.

When the toner including such toner particles is stored for a long time or continuously used, wax unevenly distributed in the vicinity of the surface of the toner particles exudes and may cause contamination of parts.

In addition, similarly to large voids, the location where the wax is unevenly distributed is likely to be the starting point of cracking and chipping.

Meanwhile, when the binder resin and the wax are rapidly cooled from the state of being melted uniformly, the binder resin of the toner particles is solidified while this state is maintained, so that the wax and the binder resin are present in a state of being entangled at the molecular level, that is, in a "compatible state".

In this case, unlike when performing gentle cooling, the wax tends to be finely dispersed in the toner particles rather than forming a large domain. In particular, when a small void is present near the center of the toner particle as in the present invention, the wax is finely dispersed also near the center. Therefore, it is preferable for suppressing both exudation of wax and cracking and chipping.

In addition, when cooling is performed at the cooling rate described above, solidification of the binder resin is sufficiently fast with respect to the moving time of the wax, and the effect of rapid cooling is remarkable.

For example, an operation of mixing cold water or ice, an operation of bubbling the dispersion with cold air, an operation of removing heat of the dispersion by using a heat exchanger, and the like can be used as a means for rapidly cooling the dispersion.

The cooling rate is preferably about 1200° C./min or less.

When the cooling rate is greater than about 1200° C./min, since the wax is compatible at random positions inside the toner particle before being adjacent to a void, it is difficult to control the position of the wax by controlling the position of the void.

Annealing Treatment Step

It is preferable that a step (e) be included in which the toner particles formed through the polymerization step are held in a temperature range of from Tg−10° C. to Tg+10° C. for 30 min or more. Here, the Tg is the glass transition temperature (° C.) of the toner particle.

The step (e) may be carried out in the state of a dispersion obtained in the step (a) in which the toner particles are dispersed in the aqueous medium.

In addition, the step (e) may be carried out in the state of a dispersion in which the toner particles are dispersed in an aqueous medium, the dispersion being obtained by washing, filtering, and drying the toner particles obtained in the step (a), and then dispersing the particles again in the aqueous medium.

In this step, the degree of crystallization is improved due to generation of crystal nuclei of the wax and crystal growth inside the toner particle.

The generation of crystal nuclei and crystal growth can be carried out in the temperature range mentioned hereinabove with respect to the glass transition temperature Tg of the binder resin.

As a result of keeping the temperature of the dispersion within this temperature range, the formation of crystal nuclei is started while molecules of the crystalline substance gradually move. Where the temperature is further kept, molecules of the wax move further, and crystal growth is performed on the crystal nuclei formed earlier as the base points.

It is more preferable that the step (e) be carried out after carrying out the step (d).

By promoting crystal growth of the wax at (Tg of the toner particle)±10 (° C.) after carrying out the step (d), a large number of crystal nuclei of the wax are formed inside the toner particles.

In the case of having crystal nuclei of the wax finely dispersed in the toner particle, it is possible to cause crystal growth of wax compatible with the binder resin by using the crystal nuclei. Therefore, the amount of compatible wax remaining inside the toner particle is very small.

Since the exudation of the wax is mainly caused by the compatible wax, the storability of the obtained toner particles is very good. In particular, since the crystallized wax is positioned near the center of the toner particle, the effect is particularly high.

In order to sufficiently improve the degree of crystallization within the range of the above-mentioned temperature region, it is preferable that the holding time be 30 min or longer. The more preferable holding time is 90 min or more, and even more preferable time is 120 min or more. Meanwhile, the upper limit value of the holding time is about 1440 min at which the effect of holding is saturated.

When holding is performed in a temperature region lower than Tg−10 (° C.), since the binder resin is sufficiently solidified, crystal nuclei of compatible wax are unlikely to be formed.

In addition, when holding is performed in a temperature range higher than Tg+10 (° C.), since the binder resin is not solidified, when the wax is not finely dispersed, it is difficult to obtain the effect of the annealing treatment.

Washing Step, Solid-Liquid Separation Step and Drying Step

For the purpose of removing the dispersion stabilizer attached to the surface of obtained toner particles, an acid or an alkali may be added to the dispersion to remove the dispersion stabilizer.

Thereafter, the toner particles are separated from the liquid phase by a general solid-liquid separation method, but in order to completely remove the acid or alkali and the dispersion stabilizer component dissolved therein, the toner particles may be washed again with water. This washing step may be repeated several times, and after sufficient washing, solid-liquid separation is carried out again to obtain the toner particles. The obtained toner particles are preferably dried by a known drying means.

Classification Step

The obtained toner particles have a sufficiently sharp particle size distribution. However, in the case where a sharper particle size is required, classification is performed by an air classifier or the like, whereby toner particles that deviate from a desired particle size distribution are sorted out and removed.

External Addition Step

An additive may be externally added to the obtained toner particles to obtain a toner.

In the external addition step, additives (sometimes referred to as external additives) designed to impart various properties to the toner may be used.

From the viewpoint of durability at the time of adding the additive to the toner, it is preferable that the additive have a particle diameter which is 1/10 or less of the weight average particle diameter of the toner particles.

The particle diameter of the additive means the number average particle diameter obtained by observation under an electron microscope.

The step (b) will be described hereinbelow in detail, but this description is not limiting.

Preparation of Mixed Solution

A mixed solution is prepared by mixing a toner particle composition including a binder resin, a colorant and a wax and an organic solvent capable of dissolving the binder resin.

In the preparation method, a binder resin, a colorant, a wax or the like may be gradually added, while stirring, to an organic solvent capable of dissolving the binder resin, followed by dissolution or dispersion. However, in the case of using a pigment as a colorant, or adding a substance, such as wax, a charge control agent, or the like, which hardly dissolves in an organic solvent, the particles may be reduced in size prior to addition to the organic solvent.

For dispersing, a known disperser such as a bead mill or a disk mill can be used.

Granulation Step

The mixed solution is dispersed in an aqueous medium to form particles of the mixed solution.

The mixed solution is charged into an aqueous medium including a surfactant or inorganic fine particles having poor water solubility, and then dispersed to form particles of the mixed solution in the aqueous medium. Thus, a dispersion including particles of the mixed solution is obtained.

When the toner particle composition includes a modified resin having an isocyanate group, a binder resin may be formed by adding an active hydrogen group-containing compound and reacting the active hydrogen group-containing compound with the modified resin having a moiety capable of reacting with the active hydrogen group-containing compound in the aqueous medium.

In the production method, by providing a device having a defoaming function in the circulation flow path, it is possible to control the size and position of a void in the toner particle having the void, and to suppress cracking and chipping.

In the granulation step, it is possible to use the granulation system shown in FIGS. 1 to 3 in the same manner as in the granulation step of the step (a), but such a system is not limiting.

Specifically, in the granulation step of forming the particles of the mixed solution in the aqueous medium, granulation is performed by causing circulation flow of the mixed solution and the aqueous medium in the circulation flow path which includes the tank I (1 in the figure) having a stirring means installed therein and in which the device 7 having a defoaming function is provided.

More specifically, the granulation may be carried out in the same manner as in the granulation step in the above-mentioned step (a).

As the surfactant, the following compounds can be mentioned.

Anionic surfactants such as alkylbenzene sulfonates, α-olefin sulfonates, phosphoric acid esters and the like;

cationic surfactants such as amine salts such as alkylamine salts, amino alcohol fatty acid derivatives, polyamine fatty acid derivatives, imidazoline or the like, and quaternary ammonium salts such as alkyltrimethylammonium salts, dialkyldimethylammonium salts, alkyldimethylbenzylammonium salts, pyridinium salts, alkylisoquinolinium salts, benzethonium chloride and the like;

nonionic surfactants such as fatty acid amide derivatives, polyhydric alcohol derivatives and the like; and amphoteric surfactants such as alanine, dodecyl di(aminoethyl) glycine, di(octylaminoethyl) glycine, N-alkyl-N,N-dimethylammonium betaines and the like.

As the dispersion stabilizer, those exemplified in relation to the preparation of the aqueous medium of the above step (a) may be used.

Solvent Removal Step

After the above granulation step, the organic solvent present in the particles of the obtained mixed solution is removed.

For example, it is possible to use a method of gradually raising the temperature while stirring the entire system, and completely evaporating and removing the organic solvent in the particles. Alternatively, the dispersion containing the particles of the mixed solution may be decompressed while stirring, and the organic solvent may be removed by evaporation.

Maturing Step

When the toner particle composition includes a modified resin having an isocyanate group, a maturing step may be carried out in order to advance extension and crosslinking reaction of isocyanate.

The maturing time is usually about 10 min to 40 h, preferably about 2 h to 24 h.

The reaction temperature is usually about 0° C. to 65° C., preferably about 35° C. to 50° C.

The solvent removal step and the maturing step may be carried out in the same container or in separate containers.

Cooling Treatment Step

It is preferable to carry out the same treatment as the cooling treatment step of the aforementioned step (a) on the toner particles formed through the solvent removal step. The reason for this is the same as that relating to the cooling treatment step in the aforementioned step (a).

Where the heating temperature in the solvent removal step in the step (b) exceeds the higher one of the crystallization temperature Tc (° C.) of the wax and the glass transition temperature Tg (° C.) of the toner particle, it can be assumed that step (c) has been carried out.

Annealing Treatment Step

It is preferable to carry out the same treatment as the annealing treatment step of the aforementioned step (a) on the toner particles formed through the solvent removal step. The reason for this is the same as that relating to the annealing treatment step in the aforementioned step (a).

Washing Step, Solid-Liquid Separation Step, Drying Step, Classification Step and External Addition Step With respect to the above steps, operations similar to those in the above-mentioned step (a) may be performed.

Hereinafter, the measurement methods used in the present invention will be described.

Method for Measuring Volume-Based Median Diameter (Dv50) and Number-Based Median Diameter (Dn50) of Toner Particles The volume-based median diameter (Dv50) and the number-based median diameter (Dn50) of the toner particles are calculated in the following manner.

As a measuring device, a precision particle size distribution measuring device "Coulter Counter Multisizer 3" (registered trademark, manufactured by Beckman Coulter, Inc.) equipped with a 100 μm aperture tube is used. To set measurement conditions and analyze measurement data, the dedicated special software "Beckman Coulter Multisizer 3 Version 3.51" (manufactured by Beckman Coulter, Inc.) is used. The measurement is performed with the number of effective measurement channels of 25,000 channels.

An electrolytic aqueous solution used for the measurement can be prepared by dissolving special grade sodium chloride in ion exchanged water to a concentration of about 1 mass %. For example, "ISOTON II" (manufactured by Beckman Coulter, Inc.) can be used.

The dedicated software is set up in the following manner before the measurement and analysis.

The total count number in a control mode is set to 50,000 particles on a "CHANGE STANDARD MEASUREMENT METHOD (SOM)" screen in the dedicated software, the number of measurements is set to 1, and a value obtained using "standard particles 10.0 μm" (manufactured by Beckman Coulter, Inc.) is set as a Kd value. The threshold and the noise level are automatically set by pressing the "MEASUREMENT BUTTON OF THE THRESHOLD/NOISE LEVEL". Further, the current is set to 1600 μA, the gain is set to 2, the electrolytic solution is set to ISOTON II, and "FLUSH OF APERTURE TUBE AFTER MEASUREMENT" is checked.

In the "PULSE TO PARTICLE DIAMETER CONVERSION SETTING" screen of the dedicated software, the bin interval is set to a logarithmic particle diameter, the particle diameter bin is set to a 256-particle diameter bin, and a particle diameter range is set from 2 μm to 60 μm.

A specific measurement method is described hereinbelow.

(1) Approximately 200 mL of the electrolytic aqueous solution is placed in a glass 250 mL round-bottom beaker dedicated to Multisizer 3, the beaker is set in a sample stand, and stirring with a stirrer rod is carried out counterclockwise at 24 rpm. Dirt and air bubbles in the aperture tube are removed by the "FLUSH OF APERTURE" function of the dedicated software.

(2) Approximately 30 ml of the electrolytic aqueous solution is placed in a glass 100 mL flat-bottom beaker. Then, about 0.3 mL of a diluted solution obtained by 3-fold mass dilution of "CONTAMINON N" (10% by mass aqueous solution of a neutral detergent for washing precision measuring instruments of pH 7 consisting of a nonionic surfactant, an anionic surfactant, and an organic builder, manufactured by Wako Pure Chemical Industries, Ltd.) with ion exchanged water is added.

(3) An ultrasonic disperser "Ultrasonic Dispersion System Tetora 150" (manufactured by Nikkaki Bios Co., Ltd.) with an electrical output of 120 W in which two oscillators with an oscillation frequency of 50 kHz are built in with a phase shift of 180 degrees is prepared. About 3.3 L of ion exchanged water is placed in the water tank of the ultrasonic disperser, and about 2 mL of CONTAMINON N is added to the water tank.

(4) The beaker of (2) hereinabove is set in the beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) About 10 mg of the toner particles is added little by little to the electrolytic aqueous solution and dispersed therein in a state in which the electrolytic aqueous solution in the beaker of (4) hereinabove is irradiated with ultrasonic waves. Then, the ultrasonic dispersion process is further continued for 60 s. During the ultrasonic dispersion, the water temperature in the water tank is appropriately adjusted to a temperature from 10° C. to 40° C.

(6) The electrolytic aqueous solution of (5) hereinabove in which the toner is dispersed is dropped by using a pipette into the round bottom beaker of (1) hereinabove which has been set in the sample stand, and the measurement concentration is adjusted to be about 5%. Then, measurement is conducted until the number of particles to be measured reaches 50,000.

(7) The measurement data are analyzed with the dedicated software provided with the device, and the volume-based median diameter (Dv50) and the number-based median diameter (Dn50) are calculated.

The particle size distribution is sharper as the ratio (Dv50/Dn50) of Dv50 to Dn50 is closer to 1.00.

Measurement Methods Relating to Voids and Wax

In the present invention, an electron staining method is used by which the electron density of one component is increased with a heavy metal to give a contrast between materials by using the difference in microstructure between a crystalline phase and an amorphous phase.

Specifically, toner particles modified with osmium tetroxide ($OsO_4$) are sufficiently dispersed in a photocurable epoxy resin, and then the photocurable resin is cured. Thereafter, a flaky sample having a size of 300 mm square and a thickness of 70 mm is cut out from the obtained cured product by using an Ultramicrotome (UC 7, manufactured by Leica) equipped with a diamond knife.

Subsequently, electron staining is carried out using ruthenium tetroxide ($RuO_4$) in combination.

Specifically, a vacuum electron staining device (VSC 4R1H, manufactured by Filgen Co.) is used, and the flaked sample is placed in a chamber and subjected to a staining treatment in a $RuO_4$ gas atmosphere at 500 Pa for a staining time of 15 min.

The stained sample is enlarged at a magnification of 10,000 times by using a scanning image mode of a scanning transmission electron microscope (JEM 2800, JEOL) to acquire a cross-sectional image of a toner particle.

At this time, the probe size of the scanning transmission electron microscope (STEM) is 1 nm, the image size is 2048×2048, and the image is acquired at an acceleration voltage of 200 KV.

The cross section of the toner particle selected for observation has a maximum diameter which is 0.7 times to 1.3 times the Dn50 when measuring the toner particles according to the method for measuring the median diameter (Dn50) based on the number of the toner particles.

In the obtained cross section of the toner particle, the long diameter of a void, the distance from the outline of the cross section to the void, the distance from the outline of the cross section to the wax, and the distance between the void and the wax are measured.

In the measurement, the observation image of the cross section of 500 toner particles selected according to the above criteria is acquired, and the scale displayed on the observation image is used to obtain proportions from the following calculation formulas.

The void, as referred to herein, is an ellipse or an object of elliptical shape which is observed in black on the cross section, the long diameter thereof being 0.001 μm or more.

(Proportion of the number of toner particles having a void with a long diameter of 0.50 μm or less)=(number of cross sections of toner particles having a void with a long diameter of 0.50 μm or less)/500×100.

(Proportion of the number of toner particles having a void in a region from the outline of the cross section of the toner particle inward to 1.00 μm in the total number of the toner particles having a void)=(number of cross sections of toner particles having a void in a region from the outline of the cross section of the toner particle inward to 1.00 μm)/(total number of cross sections of toner particles having a void)×100.

(Proportion of the number of toner particles having a void with a long diameter of 1.00 μm or more) =(number of cross sections of toner particles having a void with a long diameter of 1.00 μm or more)/500×100.

The determination as to whether or not there are present two or more voids with a long diameter of 0.50 μm or less is "Present" when there are two or more voids with a long diameter of 0.50 μm or less in the cross section of all toner particles having a void with a long diameter of 0.50 μm or less among the cross sections of all the observed toner particles (that is, a total of 500 toner particles).

Regarding the comparison of Da, Db, and Dc, the magnitude relationships are compared with respect to the cross sections of all the toner particles having a void.

Here, Db (the distance from the outline of the cross section of the toner particle to the void) means the shortest distance from the outline of the cross section of the toner particle to the outline of the void, and Dc (the distance from the outline of the cross section of the toner particle to the wax) means the shortest distance from the outline of the cross section of the toner particle to the outline of the wax.

Further, when both "Da>Db" and "Da>Dc" are satisfied in all the "voids" and "wax" in the cross section of all the toner particles having a void, it is determined that formula (1) "Da>Db" and formula (2) "Da>Dc" are satisfied.

Furthermore, the shortest distance between the outline of the void and the outline of the wax in the cross section of all the toner particles having a void is measured and the maximum value among the shortest distances is used as the distance between the void and the wax.

Evaluation of Bubble Presence Amount

The bubble presence amount in the aqueous medium including the particles of the polymerizable monomer composition or the aqueous medium including the particles of the mixed solution obtained in the granulation step is evaluated by measuring a bulk specific gravity (kg/m$^3$).

The bulk specific gravity (kg/m$^3$) is measured by placing a sample in a 200 mL measuring cylinder and measuring the mass thereof.

The larger the bulk specific gravity is, the smaller the amount of bubbles contained in the sample, and the smaller the amount of bubbles taken into the particles of the polymerizable monomer composition or the particles of the mixed solution.

Method for Measuring Glass Transition Temperature Tg (° C.)

The glass transition temperature (Tg) is measured using a differential scanning calorimeter "Q1000" (manufactured by TA Instruments).

The melting points of indium and zinc are used for temperature correction of the device detection unit, and the heat of melting of indium is used for correction of the calorific value.

Specifically, about 10 mg of the sample is precisely weighed and placed in an aluminum pan. An empty aluminum pan is used as a reference.

Measurement is carried out at a temperature rise rate of 10° C./min within the measurement range of 30° C. to 200° C.

In the temperature rise process, a specific heat change is obtained in the temperature range of 40° C. to 100° C.

The intersection of the differential thermal curve and the line at the midpoint of the baseline before and after the appearance of the specific heat change is taken as the glass transition temperature Tg (° C.) of the sample.

Measurement of Crystallization Temperature Tc (° C.) of Wax

The crystallization temperature (Tc) of the wax is measured according to ASTM D 3418-82 by using a differential scanning calorimeter "Q1000" (manufactured by TA Instruments).

The melting points of indium and zinc are used for temperature correction of the device detection unit, and the heat of melting of indium is used for correction of the calorific value.

Specifically, about 10 mg of wax is precisely weighed and placed in an aluminum pan. An empty aluminum pan is used as a reference.

Measurement is performed within the measurement temperature range from 30° C. to 200° C.

In the measurement, the temperature is once raised to 200° C. at a temperature rise rate of 10° C./min, and then the temperature is decreased to 30° C. at a temperature decrease rate of 10° C./min.

The peak temperature of the exothermic peak of the differential thermal curve in the temperature range of 30° C. to 200° C. during the temperature decrease process is taken as the crystallization temperature Tc (° C.) of the wax.

EXAMPLES

Hereinafter, the present invention will be described in greater detail by way of Examples and Comparative Examples, but the present invention is not limited thereto. "Parts" and "%" described in the Examples and Comparative Examples are all on a mass basis unless otherwise specified.

Example 1

A toner was produced by the following procedure.

Preparation of Pigment Dispersion Composition

| | |
|---|---|
| Styrene | 21.76 parts |
| C.I. Pigment Red 122 | 1.98 parts |
| C.I. Pigment Red 150 | 1.13 parts |
| Charge control agent | 0.44 part |

-continued

| | |
|---|---|
| (Bontron E 88, manufactured by Orient Chemical Industries, Ltd.) | |

A pigment dispersion composition was prepared by introducing these materials into an attritor (manufactured by Nippon Coke & Engineering Co., Ltd.), stirring with zirconia beads having a radius of 1.25 mm at 200 rpm for 180 min at 25° C., and then removing the zirconia beads.

Preparation of Polymerizable Monomer Composition

The following materials were charged into a container and mixed and dispersed at a peripheral velocity of 20 m/s by using T. K. HOMOMIXER (manufactured by Primix Corporation).

| | |
|---|---|
| Pigment dispersion composition | 25.76 parts |
| Styrene | 14.55 parts |
| n-Butyl acrylate | 8.10 parts |
| Polyester resin | 2.22 parts |
| Styrene-methacrylic acid-methyl methacrylate-α-methyl styrene copolymer (Styrene/methacrylic acid/methyl methacrylate/α-methyl styrene (mass ratio) = 80.85/2.50/1.65/15.0, peak molecular weight (Mp) = 19,700 weight average molecular weight (Mw) = 7,900, glass transition temperature (Tg) = 96° C., acid value = 12.0 mg KOH/g, Mw/Mn = 2.1) | 5.33 parts |
| Sulfonic acid group-containing resin (Acrybase FCA-1001-NS, manufactured by Fujikura Kasei Co., Ltd.) | 0.44 part |

Further, after heating to 60° C., 8.0 parts of hydrocarbon wax (HNP-9, manufactured by Nippon Seiro Co., Ltd.) was added and dispersed and mixed for 30 min. Thereafter, 4.44 parts of the polymerization initiator 2,2'-azobis(2,4-dimethylvaleronitrile) was dissolved to prepare a polymerizable monomer composition.

Preparation of Aqueous Medium

A total of 117.92 parts of ion exchanged water, 2.04 parts of sodium phosphate dodecahydrate, and 0.88 parts of 10% hydrochloric acid were added to the tank I to prepare a sodium phosphate aqueous solution which was heated to 60° C.

Meanwhile, 1.18 parts of calcium chloride dihydrate was dissolved in 8.28 parts of ion exchanged water to obtain an aqueous solution of calcium chloride. The calcium chloride aqueous solution was added to the above-mentioned sodium phosphate aqueous solution, and an aqueous medium was obtained by stirring for 30 min at a peripheral velocity of 25 m/s by using T. K. HOMOMIXER (manufactured by Primix Corporation).

Granulation Step

The polymerizable monomer composition was dispersed in the aqueous medium by using the granulation system shown in FIG. 3.

A defoaming and degassing pump (manufactured by Yokota Manufacturing Co., Ltd.) was used as the device 7.

The defoaming and degassing pump is a device which has a casing and an impeller provided in the casing, and in which a discharge blade applying a discharge force to a passing fluid is formed at one axial end portion of the impeller, a fluid discharge port is provided in a casing portion opposite to the discharge blade, the other axial end portion of the impeller is formed so as to slide relative to the inner wall of the casing, an exhaust port is provided in the casing portion opposite to the sliding impeller portion, the exhaust port is communicated with a degassing device, a fluid suction port is provided between the fluid discharge port and the exhaust port, and gas-liquid separation is performed by the centrifugal force of the impeller.

Further, CAVITRON (manufactured by Eurotec Co., Ltd.) was used as the tank II having stirring means (14 and 15 in FIG. 3).

The tank I (1 in the drawing) has the inner nozzle 4 connected to the circulation flow path. Circulation was carried out in a state in which the discharge port of the inner nozzle 4 was present below the liquid level in the tank I.

First, the polymerizable monomer composition was charged into the aqueous medium and stirred at a peripheral velocity of 30 m/s by CLEARMIX (manufactured by M Technique Co., Ltd.) at a temperature of 60° C. under a nitrogen atmosphere.

Subsequently, the mixed liquid in the tank I was continuously extracted from the lower part of the tank I, and the mixed liquid was returned to the upper part of the tank I. The circulation was carried out at a circulation flow rate of 30 L/min.

Simultaneously with the circulation, the rotation speed of the device 7 was adjusted so that the centrifugal force of the outermost periphery of the separation blade of the impeller 9 of the device 7 was 420 G.

Also, by adjusting the opening degree of the suction valve 8 and the discharge valve 13, the suction pressure and discharge pressure were adjusted so that a cavity was formed in the casing of the device 7.

Then, the degassing device 12 was activated to start degassing.

The polymerizable monomer composition was dispersed in the aqueous medium at a rotor peripheral velocity of 40 m/s by using a tank II (CAVITRON) provided in the circulation flow path.

At this time, the slit width between the rotor and stator of the CAVITRON was 1.0 mm.

The circulation was performed until the cumulative flow rate of the liquid that has passed through the tank II (CAVITRON) reached 5 times the amount of liquid charged into the tank I (hereinafter, until the number of passes calculated by the following formula became 5) and a dispersion including particles of the polymerizable monomer composition was obtained.

(Number of passes)={(circulation flow rate (L/min))×(circulation time (min))}/(total mixed liquid amount (L) in tank *I*)

Polymerization Step

The obtained dispersion was transferred to another tank, and the temperature was raised to 70° C. while stirring with a paddle stirring blade.

After conducting the reaction for 5 h, the temperature was further raised to 85° C. and the reaction was conducted for 2 h to obtain a dispersion including toner particles.

At this point, a part of the dispersion was taken out, hydrochloric acid was added to the dispersion to wash and remove calcium phosphate, and filtration and drying were carried out to obtain toner particles. The glass transition temperature (Tg) of the toner particles was 52° C.

Cooling Treatment Step

The obtained dispersion including the toner particles was heated to 90° C. and held for 30 min. Thereafter, water at 5°

C. was charged into the dispersion to cool the dispersion from 90° C. to 40° C. at a cooling rate of 30° C./min (in this case, the starting temperature T1 was 90° C., the stopping temperature T2 was 40° C., and the cooling rate was 30° C./min).

Annealing Treatment Step

The cooled dispersion was heated again to 52° C. and kept at the same temperature for 180 min while being stirred with a paddle stirring blade.

Washing, Solid-Liquid Separation, Drying Steps

Thereafter, after the dispersion was cooled, hydrochloric acid was added under stirring to adjust the pH to 1.4, and subsequent stirring for 2 h produced a dispersion including toner particles. The toner particles were filtered off from the dispersion, washed with water and dried at a temperature of 40° C. for 48 h to obtain toner particles.

The volume-based median diameter (Dv50) and the particle size distribution [volume-based median diameter (Dv50)/number-based median diameter (Dn50)] of the obtained toner particles are shown in Table 2.

External Addition Step

A total of 1.0 part of hydrophobic silica fine particles surface-treated with dimethyl silicone oil (number average particle diameter of primary particles: 7 nm) was mixed with 100.0 parts of the obtained toner particles by using an FM MIXER (manufactured by Nippon Coke & Engineering Co., Ltd.) for 10 min to obtain a toner.

The obtained toner was evaluated by the following methods.

Evaluation on Developing Performance

Evaluation Machine

The process speed of commercially available LBP-2710 (manufactured by Canon Inc.) was changed to 220 mm/s, the toner was removed from a commercially available magenta cartridge, and the inside was cleaned with air blow. Thereafter, 260 g of the toner to be evaluated was filled in the magenta cartridge, toners was removed from other cyan, yellow and black cartridges and empty cartridges were inserted into stations.

Evaluation of Fogging; Evaluation 2 in Table

Evaluation of fogging was performed in the following manner.

The above evaluation machine was used to conduct a durability test by a method of pausing for 1 min every time two prints were printed at a print percentage of 1% under the following environments, and after 13,000 prints of the durability test were printed, the prints were allowed to stand for 6 days under each environment.

Normal-temperature and normal-humidity environment (N/N) Temperature: 25.0° C., humidity: 60% RH High-temperature and high-humidity environment (H/H) Temperature: 32.5° C., humidity: 85% RH Low-temperature and low-humidity environment (L/L) Temperature: 10.0° C., humidity: 10% RH The fogging amount of the first image sample thereafter was measured using REFLECT METER MODEL TC-6DS manufactured by Tokyo Denshoku Co., Ltd., calculated from the following formula and evaluated according to the following criteria.

Plain paper of A4 size (GF-0081A4 manufactured by Canon Marketing Japan Co., Ltd.) was used as the recording material used for the durability test.

Fogging amount (%)=(whiteness of recording material before printing)−(whiteness of non-image forming portion(white background portion) of recording material after printing)×100

Evaluation Criteria

A: less than 1.0%

B: from 1.0% to less than 3.0%

C: 3.0% or more

Fusion and Adhesion of Toner to Toner Bearing Member and Toner Layer Thickness Control Member; Evaluation 3 in Table Fusion and adhesion of the toner to the toner bearing member and the toner layer thickness control member were evaluated under a normal-temperature and normal-humidity environment (N/N: temperature 23.5° C., humidity 60% RH) and high-temperature and high-humidity environment (H/H: Temperature 32.5° C., humidity 80% RH) by using the above evaluation machine.

A durability test was conducted by a method of pausing for 1 min every time two prints were printed at a print percentage of 1%, and an image sample of the 8,000-th print from the beginning of the durability test was visually evaluated.

Plain paper of A4 size (GF-0081A4 manufactured by Canon Marketing Japan Co., Ltd.) was used as the recording material. The criteria for evaluating the occurrence of fusion and adhesion are shown below.

A: no occurrence on the image

B: slight occurrence on the image (from 1 to 3 slight development streaks in the end portion)

C: occurrence on the image (4 or more developing streaks in the end portion)

Evaluation of Cracking Chipping Ratio of Toner Particles; Evaluation 1 in Table

Evaluation of cracking and chipping ratio of toner particles is carried out in the following manner.

The above evaluation machine was used to conduct a durability test by a method of pausing for 1 min every time two prints were printed at a print percentage of 1% under the normal-temperature and normal-humidity environment (N/N, temperature 25.0° C., humidity 60% RH).

After 15,000 prints of the durability test were printed, the toner was taken out from the cartridge, and the toner particles were observed by the following method.

The toner particles were fixed to a stub for a scanning electron microscope and coated with platinum at a current value of 15 mA for 30 s. Thereafter, 12 fields of view were observed under a scanning electron microscope under the following conditions to evaluate cracking and chipping of the toner particles.

Measurement Conditions

Acceleration voltage: 1 kV

Measurement magnification: 2000 times

Calculation of Cracking and Chipping Ratio of Toner Particles

Cracking and chipping ratio (%)=(number of toner particles having cracking and chipping in 12 fields of view)/(number of all toner particles contained in 12 fields of view)

Evaluation Criteria

A: less than 5.0%

B: from 5.0% to less than 10.0%

C: 10.0% or more

Evaluation of Storability

Evaluation of Blocking Resistance; Evaluation 4 in Table

The blocking resistance of the toner was evaluated by the following method.

Approximately 10 g of the toner was placed in a 100 mL polypropylene cup and allowed to stand for 7 days in an environment at a temperature of 45° C. and a humidity of 95% RH and then visually evaluated.

Evaluation Criteria

A: no aggregates are observed

B: aggregates are observed slightly, but collapse easily

C: aggregates are seen, but collapse easily

D: aggregates are seen, but collapse when shaken

E: agglomerates can be grasped and do not collapse easily

Evaluation of Wettability of Toner; Evaluation 5 in Table

When the wax bleeds out, the degree of hydrophobicity of the toner particle surface increases. Accordingly, the degree of hydrophobicity of the toner was measured using a methanol wettability test.

In the evaluation of the blocking resistance, the methanol wettability was measured for the toner allowed to stand for 7 days under the environment with a temperature of 45° C. and a humidity of 95% RH and the toner that was not allowed to stand under such conditions. The rate of change in the degree of hydrophobicity was determined by the following formula.

As the rate of change in the degree of hydrophobicity increases, the wax starts bleeding out in a high-temperature and high-humidity environment.

Rate of change in degree of hydrophobicity=(degree of hydrophobicity of toner after the toner was allowed to stand)/(degree of hydrophobicity of toner that was not allowed to stand).

The degree of hydrophobicity of the toner was determined from the methanol dropping amount-transmittance curve obtained by the following method.

First, 60 mL of water was placed in a cylindrical glass container having a diameter of 5 cm and a thickness of 1.75 mm, and dispersed for 5 min with an ultrasonic disperser in order to remove air bubbles and the like in the water.

Subsequently, the toner was sieved with a mesh having an opening of 150 μm, and 0.1 g of the toner that passed through the mesh was accurately weighed and added to the container containing the above water to prepare a sample liquid for measurement.

Then, the sample liquid for measurement was set on a powder wettability tester "WET-100P" (manufactured by RESCA Co., Ltd.) and stirred at a rate of 5.0 $s^{-1}$ (300 rpm) by using a magnetic stirrer.

A spindle type rotor coated with fluorine resin and having a length of 25 mm and a maximum barrel diameter of 8 mm was used as a rotor of the magnetic stirrer.

Next, the transmittance was measured with light having a wavelength of 780 nm while continuously adding methanol at a dropping rate of 0.8 mL/min to the sample liquid for measurement through the above-mentioned device, and the methanol dropping amount-transmittance curve was plotted.

From the obtained methanol dropping amount-transmittance curve, the methanol concentration at the time when the transmittance was 50% was defined as the degree of hydrophobicity.

Image Durability Test after Allowing to Stand Under High-Temperature and High-Humidity Environment; Evaluation 6 in Table In the evaluation of the blocking resistance, the toner allowed to stand for 7 days under the environment with a temperature of 45° C. and a humidity of 95% RH and a ferrite carrier (average particle diameter 42 μm) coated with a silicone resin were mixed to obtain a toner concentration of 6% by mass, thereby preparing a two-component developer.

Using a commercially available full-color digital copying machine (trade name: CLC 700, manufactured by Canon Inc.), printing test of 15,000 prints was performed under the environment with a temperature of 32.5° C. and a humidity of 80% RH.

After printing 15,000 sheets, a solid image was outputted, and the density of the solid image was measured using a "Macbeth reflection densitometer RD918" (manufactured by Macbeth Co.) as a reflection density of a white background portion having a document density of 0.00 related to the print-out image.

Thereafter, evaluation was performed using the density difference between the highest density and the lowest density in the image.

When the toner is damaged under a high-temperature and high-humidity environment, movement in the cartridge deteriorates and image density non-uniformity occurs. Evaluation criteria are presented hereinbelow. The worst value under the test is indicated in the table.

A: density difference less than 0.10

B: density difference from 0.10 to less than 0.15

C: density difference from 0.15 to less than 0.20

D: density difference from 0.20 to less than 0.25

E: density difference 0.25 or more

Examples 2, 4 to 10, and 12 to 25

Toners were produced in the same manner as in Example 1 and evaluated in the same manner as in Example 1, except that the conditions were changed to those shown in Table 1-1 and Table 1-2.

In Example 12, a toner was produced in the same manner as in Example 1 and evaluated in the same manner as in Example 1, except that the tank I was not provided with the inner nozzle 4.

In Example 13, a toner was produced in the same manner as in Example 1 and evaluated in the same manner as in Example 1, except that a defoaming pump (manufactured by Fushida Metal Industry Co., Ltd.) was used as the device 7 and gas-liquid separation by an impeller was not performed.

Example 3

A toner was produced in the same manner as in Example 1 and evaluated in the same manner as in Example 1 except that the granulation system shown in FIG. 2 was used instead of the granulation system shown in FIG. 3 and the conditions were changed to those shown in Table 1-1.

Example 11

A toner was produced in the same manner as in Example 1 and evaluated in the same manner as in Example 1 except that the granulation system shown in FIG. 1 was used instead of the granulation system shown in FIG. 3 and the conditions were changed to those shown in Table 1-1.

Example 26

Preparation of Aqueous Medium

A total of 5.36 parts of sodium phosphate dodecahydrate and 2.32 parts of 10% hydrochloric acid were added to 330 parts of ion exchanged water, and the mixture was heated to 60° C. while being stirred at 3,000 r/min by using HIGH-SHEAR MIXER (manufactured by IKA).

An aqueous solution prepared by dissolving 3 parts by mass of calcium chloride dihydrate in 21.78 parts of ion exchanged water was added thereto, and after 30 min, 15 parts of a 48.5% aqueous solution of sodium dodecyl diphenyl ether disulfonate (Eleminol MON-7, manufactured by Sanyo Chemical Industries, Ltd.) and 30 parts of ethyl acetate were added, and the liquid temperature was lowered to 30° C. to prepare an aqueous medium.

Preparation of Master Batch

| | |
|---|---|
| C.I. Pigment Red 122 | 22 parts |
| C.I. Pigment Red 150 | 18 parts |
| Unmodified polyester resin A (SREL 0-005, manufactured by Sanyo Chemical Industries, Ltd.) | 59 parts |

The above materials were kneaded at 150° C. for 30 min by using a twin-roll mill, rolled and cooled, and pulverized with a pulverizer to obtain a master batch.

Synthesis of Intermediate Polyester and Prepolymer

| | |
|---|---|
| Bisphenol A ethylene oxide 2 mol adduct | 683 parts |
| Bisphenol A propylene oxide 2 mol adduct | 81 parts |
| Terephthalic acid | 283 parts |
| Trimellitic anhydride | 22 parts |
| Dibutyltin oxide | 2 parts |

The above materials were charged into a reaction vessel and reacted at 230° C. for 8 h under atmospheric pressure.

Subsequently, an intermediate polyester was synthesized by conducting the reaction under a reduced pressure of 10 mmHg to 15 mmHg for 5 h.

Next, the following materials were added and the reaction was conducted at 100° C. for 5 h to synthesize a prepolymer.

| | |
|---|---|
| Intermediate polyester | 410 parts |
| Isophorone diisocyanate | 89 parts |
| Ethyl acetate | 500 parts |

Synthesis of Ketimine

A total of 170 parts of isophorone diamine and 75 parts of methyl ethyl ketone were charged in a reaction vessel and reacted at 50° C. for 5 h to synthesize a ketimine compound.

Preparation of Wax-Dispersed Solution

| | |
|---|---|
| Unmodified polyester resin (SREL 0-005, manufactured by Sanyo Chemical Industries, Ltd.) | 100 parts |
| Ester wax (behenyl behenate) | 90 parts |
| Ethyl acetate | 400 parts |

The above materials were stirred and dispersed for 10 min by using a propeller blade and then dispersed for 8 h using a Dyno-mill to obtain a wax-dispersed solution.

Preparation of Toner Particle Composition

A total of 150 parts of the master batch, 700 parts by mass of the unmodified polyester resin A and 850 parts by mass of ethyl acetate were charged into a vessel equipped with a stirrer and a thermometer, and the components were mixed for 10 min by using T. K. HOMOMIXER (manufactured by Primix Corporation) at a rotation speed of 9,000 rpm.

Thereafter, the rotation speed of T. K. HOMOMIXER was set to a peripheral velocity of 20 m/s while cooling the vessel, and stirring was carried out until the liquid temperature reached 30° C.

After the liquid temperature reached 30° C., 200 parts of the wax-dispersed solution was added while further cooling the vessel, and mixing and stirring were carried out while adjusting the rotation speed so that the liquid temperature did not become 45° C. or higher.

A total of 194 parts of the prepolymer and 6 parts of the ketimine compound were added and stirred at 5000 rpm for 30 s to obtain a mixed solution including the toner particle composition.

Granulation Step

The toner particle composition was dispersed in an aqueous medium by using the granulation system shown in FIG. 3.

A defoaming and degassing pump (manufactured by Yokota Manufacturing Co., Ltd.) was used as the device 7.

Further, CAVITRON (manufactured by Eurotec Co., Ltd.) was used as the tank II having stirring means (14 and 15 in FIG. 3).

The tank I (1 in the drawing) had the inner nozzle 4 connected to the circulation flow path. Circulation was carried out in a state in which the discharge port of the inner nozzle 4 was present below the liquid level in the tank I.

First, 140 parts of the aqueous medium and 60 parts of the toner particle composition were charged into the tank I.

The components were stirred at a peripheral velocity of 30 m/s by CLEARMIX (manufactured by M Technique Co., Ltd.) at a temperature of 60° C. under a nitrogen atmosphere.

Subsequently, the mixed liquid in the tank I was continuously extracted from the lower part of the tank I, and the mixed liquid was returned to the upper part of the tank I. The circulation was carried out at a circulation flow rate of 30 L/min.

Simultaneously with the circulation, the rotation speed of the device 7 was adjusted so that the centrifugal force of the outermost periphery of the separation blade of the impeller 9 of the device 7 was 420 G.

Also, by adjusting the opening degree of the suction valve 8 and the discharge valve 13, the suction pressure and discharge pressure were adjusted so that a cavity was formed in the casing of the device 7.

Then, the degassing device 12 was activated to start degassing.

The mixed solution including the toner particle composition was dispersed in the aqueous medium at a rotor peripheral velocity of 40 m/s by using the tank II (CAVITRON) provided in the circulation flow path.

At this time, the slit width between the rotor and stator of the CAVITRON was 1.0 mm.

The circulation was performed until the cumulative flow rate of the liquid that has passed through the tank II (CAVITRON) reached 5 times the amount of liquid charged into the tank I (hereinafter, until the number of passes calculated by the formula above became 5) and a dispersion including particles of the mixed solution was obtained.

Solvent Removal Step, Maturing Step

The obtained dispersion was transferred to a container continuously adjusted to a temperature of 30° C., stirring was started at a rotation speed of 50 rpm, and solvent removal was carried out for 10 h. Subsequently, the inner temperature of the jacket of the container was set at 80° C., the temperature inside the container was raised to 55° C., and maturing was carried out at 55° C. for 5 h to obtain a dispersion including toner particles.

At this point, a part of the dispersion was taken out, hydrochloric acid was added to the dispersion, and filtration and drying were carried out to obtain toner particles. The glass transition temperature Tg of the toner particles was 50.5° C.

Cooling Treatment Step

The obtained dispersion including the toner particles was heated to 90° C. and held for 30 min. Thereafter, water at 5° C. was charged into the dispersion to cool the dispersion from 90° C. to 40° C. at a cooling rate of 30° C./min (in this case, the starting temperature T1 was 90° C., the stopping temperature T2 was 40° C., and the cooling rate was 30° C./min).

Annealing Treatment Step

The cooled dispersion was again heated to 50.5° C. and kept at the same temperature for 180 min while being stirred with a paddle stirring blade.

Washing, Solid-Liquid Separation, Drying Steps

Thereafter, after the dispersion was cooled, hydrochloric acid was added under stirring to adjust the pH to 1.4, and subsequent stirring for 2 h produced a dispersion including toner particles. The toner particles were filtered off from the dispersion, washed with water and dried at a temperature of 40° C. for 48 h to obtain toner particles.

The volume-based median diameter (Dv50) and the particle size distribution [volume-based median diameter (Dv50)/number-based median diameter (Dn50)] of the obtained toner particles are shown in Table 2.

External Addition Step

A total of 1.0 part of hydrophobic silica fine particles surface-treated with dimethyl silicone oil (number average particle diameter of primary particles: 7 nm) was mixed with 100.0 parts of the obtained toner particles by using an FM MIXER (manufactured by Nippon Coke & Engineering Co., Ltd.) for 10 min to obtain a toner.

The obtained toner was evaluated in the same manner as in Example 1.

Comparative Example 1

A toner was produced in the same manner as in Example 1 and was evaluated in the same manner as in Example 1, except that the exhaust port of the device 7 was fully closed, the degassing device 12 provided in the device 7 did not extract air bubbles, and the conditions were changed to those shown in Table 1-3.

Comparative Example 2

A toner was produced in the same manner as in Example 1 and was evaluated in the same manner as in Example 1, except that in the granulation step of Example 1, granulation was carried out by a batch operation without circulating the mixed liquid in the tank I, and the conditions were changed to those shown in Table 1-3.

Comparative Example 3

A toner was produced in the same manner as in Example 26 and was evaluated in the same manner as in Example 1, except that the exhaust port of the device 7 was fully closed, the degassing device 12 provided in the device 7 did not extract air bubbles, and the conditions were changed to those shown in Table 1-3.

Comparative Example 4

A toner was produced in the same manner as in Example 26 and was evaluated in the same manner as in Example 1, except that in the granulation step of Example 26, granulation was carried out by a batch operation without circulating the mixed liquid in the tank I, and the conditions were changed to those shown in Table 1-3.

Comparative Example 5

A total of 700 parts of a low-viscosity polyester resin, 80 parts of a medium-viscosity polyester resin, 140 g parts of a high-viscosity polyester resin, 50 parts of a wax, and 38 parts of a colorant were mixed using a mixer ("FM MIXER" manufactured by Nippon Coke & Engineering Co., Ltd.) at a speed of 2400 rpm.

In the low-viscosity polyester resin, Tg is 38° C. and Tm is 65° C.

In the medium-viscosity polyester resin, Tg is 53° C. and Tm is 84° C.

In the high-viscosity polyester resin, Tg is 71° C. and Tm is 120° C.

"KET Blue 111" (phthalocyanine blue) manufactured by DIC Corporation was used as the colorant, and hydrocarbon wax (HNP-9, manufactured by Nippon Seiro Co., Ltd.) was used as the wax.

Subsequently, the obtained mixture was melt-kneaded using a twin-screw extruder ("PCM-30" manufactured by Ikegai Corporation) under the conditions of a material input amount of 5 kg/h, a shaft rotation speed of 160 rpm, a set temperature range of from 100° C. to 130° C. Thereafter, the obtained melt-kneaded product was cooled.

Subsequently, the melt-kneaded material was coarsely pulverized using a mechanical pulverizer ("ROTOPLEX 16/8 type" manufactured by Toa Machinery Co., Ltd.). Further, the coarsely pulverized product was finely pulverized using a jet mill ("Ultrasonic Jet Mill I Type" manufactured by Nippon Pneumatic Mfg. Co., Ltd.).

Subsequently, the finely pulverized material was classified using a classifier ("ELBOW JET EJ-LABO type" manufactured by Nittetsu Mining Co., Ltd.). As a result, core particles having a volume-based median diameter of 5.3 μm were obtained.

Formation of Shell Layer

A three-necked flask having a volume of 1 L and equipped with a thermometer and a stirring blade was prepared. A total of 500 parts of ion exchanged water and 50 parts of sodium polyacrylate ("JURYMER (registered trademark) AC-103" manufactured by Toagosei Co., Ltd.) were added into the flask. As a result, an aqueous solution of sodium polyacrylate was obtained in the flask.

Subsequently, 100 parts of the core particles prepared by the above procedure were added to the aqueous solution of sodium polyacrylate. Thereafter, the content of the flask was thoroughly stirred at room temperature. As a result, a dispersion of the core particles was obtained in the flask.

Subsequently, the dispersion of the core particles was filtered using filter paper having openings of 3 μm. As a result, the core particles were separated by filtration. Subsequently, the core particles were redispersed in ion exchanged water. Thereafter, the core particles were washed by repeating filtration and redispersion five times. Subsequently, a suspension in which 100 parts of core particles were dispersed in 500 parts of ion exchanged water was prepared in a flask.

Subsequently, 1 part of methylol urea ("MIRBANE RESIN SU-100" manufactured by Showa Denko KK) was added to the flask, and the content of the flask was stirred to dissolve the methylol urea in the suspension.

Subsequently, dilute hydrochloric acid was added to the flask, and the pH of the suspension in the flask was adjusted to 4.

Subsequently, the suspension was stirred for 45 min by using a stirring and defoaming device ("SNW-VS" manufactured by Sanplatec Corp.) equipped with a disper-type dispersing blade having a diameter of 50 mm under an environment where the pressure was reduced to −0.096 MPa. The rotation speed of the dispersing blade was 1200 rpm. As a result, the suspension was defoamed. In addition, it is considered that bubbles that entered mainly during kneading remained in the suspension before the defoaming.

Subsequently, the suspension was transferred to a 1 L separable flask. Subsequently, the content of the flask was heated under stirring (the temperature in the flask was raised to 70° C.) and the state at 70° C. was maintained for 2 h.

The core particles and the material of the shell layer thus underwent polymerization reaction in the flask, and a shell layer composed of a thermosetting resin (urea resin) was formed on the surface of the core particles.

As a result, a dispersion containing toner particles was obtained.

Thereafter, the pH of the dispersion was adjusted (neutralized) to 7 by addition of sodium hydroxide. Further, the dispersion was cooled to room temperature (25° C.).

Washing and Drying Step

After formation of the toner particles (core and shell layer), the dispersion was filtered (solid-liquid separation) to obtain toner particles. Thereafter, the toner particles were redispersed in ion exchanged water. Further, dispersion and filtration were repeated to wash the toner particles. Thereafter, the toner particles were dried. Since the washing (dispersion and filtration) was repeatedly performed, almost no dispersant (sodium polyacrylate) remained inside the toner particles and on the surface thereof.

External Addition Step

A total of 2.0 parts of hydrophobic silica fine particles surface-treated with dimethylsilicone oil (number average particle diameter of primary particles: 7 nm) were mixed for 10 min with 100 parts of the obtained toner particles by using an FM MIXER (Nippon Coke & Engineering Co., Ltd.) to obtain a toner.

The obtained toner was evaluated by the same method as in Example 1.

Comparative Example 6

Toner Material Liquid Preparation Step

Synthesis of Unmodified Polyester (Low-Molecular-Weight Polyester) A

A total of 225 parts of ethylene oxide 2 mol adduct of bisphenol A, 530 parts of propylene oxide 3 mol adduct of bisphenol A, 211 parts of terephthalic acid, 44 parts of adipic acid, and 12 parts of dibutyl tin oxide were charged in a reaction vessel equipped with a cooling tube, a stirrer, and a nitrogen introducing tube, and a reaction was conducted for 8 h at 230° C. under normal pressure. Subsequently, the reaction liquid was allowed to react for 5 h under reduced pressure of 10 mmHg to 15 mmHg, 44 parts of trimellitic anhydride was added to the reaction vessel, and the mixture was allowed to react for 2 h at 180° C. under normal pressure to synthesize an unmodified polyester A.

Preparation of Master Batch A

A total of 420 parts of water, 420 parts of Pigment Yellow 74 as a colorant, and 600 parts of the unmodified polyester A were mixed using a Henschel mixer (manufactured by Mitsui Mining Co., Ltd.). The mixture was kneaded for 30 min with twin rolls at 150° C., rolled and cooled, and pulverized with a pulverizer (manufactured by Hosokawa Micron Corporation) to prepare a master batch A.

Synthesis of Wax Dispersant

A total of 600 parts of xylene and 300 parts of low-molecular-weight polyethylene (SANWAX LEL-400, manufactured by Sanyo Chemical Industries, Ltd., ½ method softening point 128° C.) were thoroughly dissolved in an autoclave reaction vessel equipped with a thermometer and a stirrer. After nitrogen replacement, a mixed solution of 2310 parts of styrene, 270 parts of acrylonitrile, 150 parts of butyl acrylate, 78 parts of di-t-butylperoxyhexahydroterephthalate and 455 parts of xylene was added dropwise at 175° C. over 3 h for polymerization, followed by holding for 30 min at this temperature. Subsequently, the solvent was removed to obtain a wax dispersant.

Preparation of Wax-Dispersed Solution (1)

A total of 378 parts of the unmodified polyester A, 110 parts of wax (Microcrystalline Wax, Bee Square 180, manufactured by Toyo ADL Corporation, melting point 67° C.), 66 parts of wax dispersant, and 947 parts of ethyl acetate were charged in a reaction vessel equipped with a stirrer and a thermometer, the temperature was raised to 80° C. under stirring and kept at 80° C. for 5 h, followed by cooling to 30° C. over 1 h to obtain a wax-dispersed solution (1).

Synthesis of Prepolymer 1

A total of 675 parts of ethylene oxide 2 mol adduct of bisphenol A, 78 parts of propylene oxide 2 mol adduct of bisphenol A, 290 parts of terephthalic acid, 21 parts of trimellitic anhydride, and 2 parts of dibutyltin oxide were placed in a reaction vessel equipped with a cooling pipe, a stirrer and a nitrogen introducing tube, and the mixture was allowed to react at 230° C. for 7 h under atmospheric pressure and further reacted for 5 h under a reduced pressure of 10 mmHg to 15 mmHg to obtain "Intermediate Polyester 1".

Next, 410 parts of "Intermediate Polyester 1", 89 parts of isophorone diisocyanate, and 500 parts of ethyl acetate were placed in a reaction vessel equipped with a cooling tube, a stirrer and a nitrogen introducing tube, and the components were reacted at 100° C. for 5 h to obtain "Polymer 1".

Preparation of Organic Solvent Phase

A total of 505 parts of the master batch A and 1020 parts of ethyl acetate were charged into 2520 parts of the wax-dispersed solution (1) and mixed for 1 h to obtain a raw material solution.

A total of 1305 parts of the obtained raw material solution was transferred to a reaction vessel and subjected to three passes in a bead mill ("ULTRA VISCO MILL", manufactured by IMEX Co., Ltd.) under the conditions of a liquid feed rate of 1 kg/h, a disk peripheral velocity of 6 m/sec, and loading 0.5 mm zirconia beads to 80% by volume, and Pigment Yellow 74 and wax were dispersed. Next, 1305 parts of a 65% ethyl acetate solution of the unmodified polyester A was added to the colorant- and wax-dispersed solution, followed by dispersing by one pass in the bead mill under the same conditions as described hereinabove to prepare an organic solvent phase.

Synthesis of Ketimine (Active Hydrogen Group-Containing Compound)

A total of 170 parts of isophorone diamine and 75 parts of methyl ethyl ketone were charged in a reaction vessel equipped with a stirring rod and a thermometer, and the reaction was carried out at 50° C. for 5 h to synthesize a ketimine compound (active hydrogen group-containing compound).

The amine value of the obtained ketimine compound (active hydrogen group-containing compound) was 418 mg KOH/g.

Preparation of Toner Material Liquid

A total of 749 parts of the organic solvent phase, 115 parts of the prepolymer 1, 2.9 parts of the ketimine compound (active hydrogen group-containing compound), and 0.4 parts part of a tertiary amine compound (U-CAT 660 M, manufactured by Sanyo Chemical Industries, Ltd.) were charged into a reaction vessel and mixed by using T. K. HOMOMIXER (manufactured by Primix Corporation) at a peripheral velocity of 7.5 m/s for 1 min to prepare a toner material liquid.

Preparation of Organic Resin Particle-Dispersed Solution

A total of 683 parts of water, 20 parts of sodium salt of sulfuric acid ester of ethylene oxide methacrylate adduct ("ELEMINOL RS-30"; manufactured by Sanyo Chemical Industries, Ltd.), 78 parts of styrene, 78 parts of methacrylic acid, 120 parts of butyl acrylate, and 1 part of ammonium persulfate were charged into a reaction vessel equipped with a stirring rod and a thermometer, and stirring was performed at 400 rpm for 15 min to obtain a white emulsion. The emulsion was heated, the temperature in the system was raised to 75° C., and the reaction was carried out for 5 h. Next, 30 parts of a 1% ammonium persulfate aqueous solution was added and maturing was performed at 75° C. for 5 h to prepare an aqueous solution (organic resin fine particle-dispersed solution) including vinyl resin particles (styrene-methacrylic acid-butyl acrylate-sodium salt of sulfuric acid ester of ethylene oxide methacrylate adduct copolymer) dispersed therein.

A part of the organic resin fine particle-dispersed solution was dried to isolate the resin component, and the glass transition temperature (Tg) of the resin component was measured to be 48° C.

Preparation of Aqueous Medium Phase

A total of 990 parts of water, 35 parts of a 44% aqueous solution of sodium dodecyl diphenyl ether disulfonate ("ELEMINOL MON-7"; manufactured by Sanyo Chemical Industries, Ltd.) as a surfactant, 15 parts of the organic resin fine particle-dispersed solution, and 90 parts of ethyl acetate were mixed and stirred to obtain a milky white liquid (aqueous medium phase).

Toner Granulation Step

The toner material liquid was added to 1,200 parts of the aqueous medium phase, and the components were mixed for 20 min at a peripheral velocity of 15 m/s in T. K. HOMOMIXER (manufactured by Primix Corporation) to prepare an oil-in-water type dispersion (emulsified slurry). Thereafter, the dispersion was stirred at 300 rpm for 30 min by using a three-one motor in which blades were set to converge the emulsified particles.

Step of Removing Organic Solvent and Maturing

The obtained slurry was transferred to a recovery flask, the solvent was removed at room temperature by using an evaporator, and the slurry was charged in a reaction vessel equipped with a stirrer and a thermometer, followed by maturing at 45° C. for 4 h.

Removal of Surfactant by Washing

After centrifugal filtration of 100 parts of the matured slurry, 100 parts of ion exchanged water was added to the filter cake, followed by mixing (at a rotation speed of 10.0 m/s for 10 min) with T. K. HOMOMIXER and then filtration. A total of 100 parts of ion exchanged water was added to the obtained filter cake, followed by mixing (at a rotation speed of 10.0 m/s for 10 min) with T. K. HOMOMIXER and then centrifugal filtration. A total of 100 parts of 10% sodium hydroxide aqueous solution was added to the resulting filter cake, followed by mixing (at a rotation speed of 10.0 m/s for 10 min) with T. K. HOMOMIXER and then centrifugal filtration. A total of 300 parts of ion exchanged water was added to the resulting filter cake, and the operation of mixing (at a rotation speed of 10.0 m/s for 10 min) with T. K. HOMOMIXER and then performing centrifugal filtration was carried out twice. A total of 300 parts of ion exchanged water was added to the resulting filter cake and mixing (at a rotation speed of 10.0 m/s for 10 min) was performed with T. K. HOMOMIXER, and the pH was thereafter adjusted to 4 with a 10% hydrochloric acid solution, followed by stirring for 1 h and centrifugal filtration. A total of 300 parts of ion exchanged water was added to the resulting filter cake, and the operation of mixing (at a rotation speed of 10.0 m/s for 10 min) with T. K. HOMOMIXER and then performing centrifugal filtration was carried out twice to obtain a final filter cake.

Heating after Removal of Surfactant

A total of 300 parts of ion exchanged water was added to the obtained final filter cake to form a slurry state, followed by heating at a slurry temperature of 55° C. for 30 min under stirring and then filtering under reduced pressure.

Drying

The obtained filter cake was dried in a circulating air dryer at 45° C. for 48 h and sieved with a mesh having an opening of 75 μm to obtain toner particles.

External Addition Step

A total of 1.0 part of hydrophobic silica fine particles surface-treated with dimethyl silicone oil (number average particle diameter of primary particles: 7 nm) was mixed for 10 min with 100.0 parts of the obtained toner particles by using an FM MIXER (manufactured by Nippon Coke & Engineering Co., Ltd.) to obtain a toner.

The obtained toner was evaluated in the same manner as in Example 1.

The measurement results on the physical properties of the toner particles and the dispersion for Examples 1 to 26 and Comparative Examples 1 to 6 are shown in Table 2.

Table 3 shows the evaluation results relating to development performance and storability of the toners of Examples 1 to 26 and Comparative Examples 1 to 6.

TABLE 1-1

| | Example No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Presence/absence of circulation | Y | Y | Y | Y | Y | Y | Y | Y | Y | Y | Y | Y | Y |
| Presence/absence of defoaming during circulation with device 7 | Y | Y | Y | Y | Y | Y | Y | Y | Y | Y | Y | Y | Y |
| Presence/absence of defoaming in tank | N | N | N | N | N | N | N | N | N | N | N | N | N |

TABLE 1-1-continued

| | Example No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| Stirrer of tank I | A | A | A | A | A | A | A | A | A | A | A | A | A |
| Peripheral velocity of stirrer of tank I (m/s) | 30 | 30 | 30 | 30 | 30 | 20 | 30 | 30 | 30 | 30 | 30 | 30 | 30 |
| Circulation flow rate (L/min) | 30 | 30 | 30 | 45 | 60 | 30 | 30 | 30 | 30 | 30 | 30 | 30 | 30 |
| Number of passes | 5 | 5 | 5 | 5 | 5 | 5 | 5 | 5 | 5 | 5 | 5 | 5 | 5 |
| Presence/absence of tank II | Y | Y | Y | Y | Y | Y | Y | Y | Y | Y | N | Y | Y |
| Stirrer of tank II | B | B | B | B | B | B | B | B | B | B | — | B | B |
| Peripheral velocity of stirrer of tank II (m/s) | 40 | 40 | 40 | 40 | 40 | 45 | 40 | 40 | 40 | 40 | — | 40 | 40 |
| Slit width of stirrer of tank II (mm) | 1.0 | 3.0 | 0.4 | 1.0 | 1.0 | 0.6 | 1.0 | 1.0 | 1.0 | 1.0 | — | 1.0 | 1.0 |
| Granulation system | FIG.3 | FIG.3 | FIG.2 | FIG.3 | FIG.3 | FIG.3 | FIG.3 | FIG.3 | FIG.3 | FIG.3 | FIG.1 | FIG.3 | FIG.3 |
| Presence/absence of inner nozzle | Y | Y | Y | Y | Y | Y | Y | Y | Y | Y | Y | N | Y |
| Presence/absence of gas-liquid separation with impeller | Y | Y | Y | Y | Y | Y | Y | Y | Y | Y | Y | Y | N |
| Centrifugal force of impeller (G) | 420 | 600 | 200 | 600 | 700 | 420 | 420 | 420 | 600 | 700 | 420 | 420 | — |
| Cooling rate (° C./min) | 30 | 30 | 30 | 30 | 30 | 30 | 1000 | 1000 | 1200 | 2400 | 30 | 30 | 30 |
| Annealing holding time (min) | 180 | 180 | 180 | 180 | 180 | 180 | 50 | 40 | 180 | 180 | 180 | 180 | 180 |
| Annealing temperature (° C.) | 52 | 52 | 52 | 52 | 52 | 52 | 57 | 60 | 52 | 52 | 52 | 52 | 52 |

TABLE 1-2

| | Example No. | | | | | | | | | | | | |
|---|---|---|---|---|---|---|---|---|---|---|---|---|---|
| | 14 | 15 | 16 | 17 | 18 | 19 | 20 | 21 | 22 | 23 | 24 | 25 | 26 |
| Presence/absence of circulation | Y | Y | Y | Y | Y | Y | Y | Y | Y | Y | Y | Y | Y |
| Presence/absence of defoaming during circulation with device 7 | Y | Y | Y | Y | Y | Y | Y | Y | Y | Y | Y | Y | Y |
| Presence/absence of defoaming in tank | N | N | N | N | N | N | N | N | N | N | N | N | N |
| Stirrer of tank I | A | A | A | A | A | A | A | A | A | A | A | A | A |
| Peripheral velocity of stirrer of tank I (m/s) | 30 | 30 | 30 | 30 | 30 | 30 | 30 | 30 | 30 | 30 | 30 | 30 | 30 |
| Circulation flow rate (L/min) | 30 | 30 | 30 | 30 | 30 | 30 | 30 | 30 | 30 | 30 | 30 | 30 | 30 |
| Number of passes | 5 | 5 | 5 | 5 | 5 | 5 | 5 | 5 | 5 | 5 | 5 | 5 | 5 |
| Presence/absence of tank II | Y | Y | Y | Y | Y | Y | Y | Y | Y | Y | Y | Y | Y |
| Stirrer of tank II | B | B | B | B | B | B | B | B | B | B | B | B | B |
| Peripheral velocity of stirrer of tank II (m/s) | 40 | 40 | 40 | 40 | 40 | 40 | 40 | 40 | 40 | 40 | 40 | 40 | 40 |
| Slit width of stirrer of tank II (mm) | 1.0 | 1.0 | 1.0 | 1.0 | 1.0 | 1.0 | 1.0 | 1.0 | 1.0 | 1.0 | 1.0 | 1.0 | 1.0 |
| Granulation system | FIG.3 | FIG.3 | FIG.3 | FIG.3 | FIG.3 | FIG.3 | FIG.3 | FIG.3 | FIG.3 | FIG.3 | FIG.3 | FIG.3 | FIG.3 |
| Presence/absence of inner nozzle | Y | Y | Y | Y | Y | Y | Y | Y | Y | Y | Y | Y | Y |
| Presence/absence of gas-liquid separation with impeller | Y | Y | Y | Y | Y | Y | Y | Y | Y | Y | Y | Y | Y |
| Centrifugal force of impeller (G) | 800 | 200 | 820 | 180 | 420 | 420 | 420 | 420 | 420 | 420 | 420 | 420 | 420 |
| Cooling rate (° C./min) | 30 | 30 | 30 | 30 | 19.8 | 6 | 30 | 30 | 30 | 30 | 30 | 30 | 30 |
| Annealing holding time (min) | 180 | 180 | 180 | 180 | 180 | 180 | 30 | 20 | 180 | 180 | 180 | 180 | 180 |
| Annealing temperature (° C.) | 52 | 52 | 52 | 52 | 52 | 52 | 52 | 52 | 62 | 42 | 72 | 32 | 50.5 |

TABLE 1-3

| | Comparative Example No. | | | |
|---|---|---|---|---|
| | 1 | 2 | 3 | 4 |
| Presence/absence of circulation | Y | N | Y | N |
| Presence/absence of defoaming during circulation with device 7 | N | | N | |
| Presence/absence of defoaming in tank | N | | N | |
| Stirrer of tank I | A | A | A | A |
| Peripheral velocity of stirrer of tank I (m/s) | 35 | 35 | 35 | 35 |
| Circulation flow rate (L/min) | 30 | — | 30 | — |
| Number of passes | 5 | — | 5 | — |
| Presence/absence of tank II | Y | — | Y | — |
| Stirrer of tank II | C | — | C | — |
| Peripheral velocity of stirrer of tank II (m/s) | 50 | — | 50 | — |
| Slit width of stirrer of tank II (mm) | 3.0 | — | 3.0 | — |
| Granulation system | FIG. 3 | — | FIG. 3 | — |
| Presence/absence of inner nozzle | Y | — | Y | — |

TABLE 1-3-continued

| | Comparative Example No. | | | |
|---|---|---|---|---|
| | 1 | 2 | 3 | 4 |
| Presence/absence of gas-liquid separation with impeller | — | — | — | — |
| Centrifugal force of impeller (G) | — | — | — | — |
| Cooling rate (° C./min) | 30 | 30 | 30 | 30 |
| Annealing holding time (min) | 180 | 180 | 180 | 180 |
| Annealing temperature (° C.) | 52 | 52 | 50.5 | 50.5 |

In the table

"Y" represents "Present", and

"N" represents "Not present".

In the "Stirrer of tank I" row in the table,

"A" represents CLEARMIX (manufactured by M Technique Co., Ltd.).

In the "Stirrer of tank II" row in the table,

"B" represents CAVITRON (manufactured by Eurotech Co., Ltd.), and

"C" represents W MOTION (manufactured by M Technique Co., Ltd.).

TABLE 2

| | Example No. | | | | | | | | | | | | |
|---|---|---|---|---|---|---|---|---|---|---|---|---|---|
| | 1 | 2 | 3 | 4 | 5 | 6 | 7 | 8 | 9 | 10 | 11 | 12 | 13 |
| A | 83 | 60 | 85 | 83 | 83 | 83 | 83 | 83 | 83 | 83 | 65 | 83 | 83 |
| B | 12 | 10 | 30 | 14 | 14 | 12 | 12 | 12 | 12 | 12 | 10 | 17 | 15 |
| C | 11 | 11 | 11 | 20 | 25 | 8 | 11 | 11 | 11 | 11 | 8 | 16 | 14 |
| D | Y | N | Y | Y | Y | N | Y | Y | Y | Y | Y | Y | Y |
| E | 18 | 22 | 18 | 18 | 18 | 20 | 30 | 35 | 22 | 22 | 18 | 20 | 21 |
| F | 0.30 | 0.30 | 0.30 | 0.30 | 0.30 | 0.30 | 0.50 | 0.50 | 0.60 | 0.80 | 0.30 | 0.30 | 0.30 |
| G | 52 | 52 | 52 | 52 | 52 | 52 | 52 | 52 | 52 | 52 | 52 | 52 | 52 |
| H | 73.6 | 73.6 | 73.6 | 73.6 | 73.6 | 73.6 | 73.6 | 73.6 | 73.6 | 73.6 | 73.6 | 73.6 | 73.6 |
| I | 6.02 | 6.04 | 6.04 | 6.10 | 6.12 | 6.04 | 6.02 | 6.02 | 6.02 | 6.02 | 6.28 | 6.06 | 6.08 |
| J | 1.10 | 1.12 | 1.13 | 1.16 | 1.18 | 1.12 | 1.10 | 1.10 | 1.10 | 1.10 | 1.26 | 1.14 | 1.16 |
| K | 967 | 965 | 963 | 958 | 955 | 967 | 967 | 967 | 967 | 967 | 973 | 960 | 962 |

| | Example No. | | | | | | | | | | | | |
|---|---|---|---|---|---|---|---|---|---|---|---|---|---|
| | 14 | 15 | 16 | 17 | 18 | 19 | 20 | 21 | 22 | 23 | 24 | 25 | 26 |
| A | 83 | 83 | 83 | 83 | 83 | 83 | 83 | 83 | 83 | 83 | 83 | 83 | 81 |
| B | 10 | 13 | 8 | 14 | 12 | 12 | 12 | 12 | 12 | 12 | 12 | 12 | 14 |
| C | 9 | 12 | 7 | 13 | 11 | 11 | 11 | 11 | 11 | 11 | 11 | 11 | 13 |
| D | Y | Y | Y | Y | Y | Y | Y | Y | Y | Y | Y | Y | Y |
| E | 16 | 22 | 14 | 24 | 26 | 27 | 20 | 21 | 22 | 22 | 23 | 23 | 20 |
| F | 0.30 | 0.30 | 0.30 | 0.30 | 0.40 | 0.40 | 0.40 | 0.50 | 0.40 | 0.40 | 0.50 | 0.50 | 0.50 |
| G | 52 | 52 | 52 | 52 | 52 | 52 | 52 | 52 | 52 | 52 | 52 | 52 | 50.5 |
| H | 73.6 | 73.6 | 73.6 | 73.6 | 73.6 | 73.6 | 73.6 | 73.6 | 73.6 | 73.6 | 73.6 | 73.6 | 69.9 |
| I | 6.28 | 6.10 | 6.31 | 6.04 | 6.02 | 6.02 | 6.02 | 6.02 | 6.02 | 6.02 | 6.02 | 6.02 | 6.04 |
| J | 1.26 | 1.18 | 1.27 | 1.12 | 1.10 | 1.10 | 1.10 | 1.10 | 1.10 | 1.10 | 1.10 | 1.10 | 1.11 |
| K | 970 | 956 | 975 | 952 | 967 | 967 | 967 | 967 | 967 | 967 | 967 | 967 | 965 |

| | Comparative Example No. | | | | | |
|---|---|---|---|---|---|---|
| | 1 | 2 | 3 | 4 | 5 | 6 |
| A | 80 | 30 | 78 | 28 | 95 | 55 |
| B | 37 | 15 | 39 | 17 | 95 | 30 |
| C | 27 | 23 | 29 | 25 | 4 | 5 |
| D | N | N | N | N | Y | N |
| E | 28 | 27 | 29 | 28 | 2 | 14 |
| F | 0.30 | 0.30 | 0.30 | 0.30 | 0.60 | 0.60 |
| G | 52 | 52 | 50.5 | 50.5 | — | 48 |
| H | 73.6 | 73.6 | 69.9 | 69.9 | — | — |
| I | 6.17 | 6.28 | 6.19 | 6.30 | 6.05 | 5.92 |

TABLE 2-continued

| | | | | | | |
|---|---|---|---|---|---|---|
| J | 1.20 | 1.26 | 1.20 | 1.28 | 1.25 | 1.19 |
| K | 945 | 970 | 948 | 973 | — | — |

In the table

"Y" represents "Present",

"N" represents "Not present",

"A" represents the proportion (number %) of the number of toner particles having a void having a long diameter of 0.50 μm or less, "B" represents the proportion (number %) of the number of toner particles having a void in the region from the outline of the cross section of the toner particle inward to 1.00 μm in the total number of the toner particles, "C" represents the proportion (number %) of the number of toner particles having a void having a long diameter of 1.00 μm or more, "D" represents whether or not two or more voids having a long diameter of 0.50 μm or less are present (present or not present), "E" represents the proportion (number %) of the number of toner particles satisfying Da>Db and Da>Dc in the total number of toner particles having a void, "F" represents the distance (μm) between the void and the wax, "G" represents the glass transition temperature Tg (° C.) of the toner particles, "H" represents the crystallization temperature Tc (° C.) of the wax, "I" represents the volume-based median diameter (Dv50, unit is μm) of the toner particles, "J" represents the particle size distribution [volume-based median diameter (Dv50)/number-based median diameter (Dn50)] of toner particles, and "K" represents bulk specific gravity (kg/m$^3$).

TABLE 3

| | | Example No. | | | | | | | | | | | | |
|---|---|---|---|---|---|---|---|---|---|---|---|---|---|---|
| | | 1 | 2 | 3 | 4 | 5 | 6 | 7 | 8 | 9 | 10 | 11 | 12 | 13 |
| Evaluation 1 | (%) | 0.8 | 2.9 | 4.5 | 4.3 | 4.1 | 4.0 | 3.9 | 3.8 | 3.7 | 3.6 | 0.8 | 3.3 | 3.1 |
| | Rank | A | A | A | A | A | A | A | A | A | A | A | A | A |
| Evaluation 2 | N/N (%) | 0.3 | 0.3 | 0.3 | 0.3 | 0.3 | 0.3 | 0.3 | 0.3 | 0.3 | 0.3 | 0.3 | 0.3 | 0.3 |
| | Rank | A | A | A | A | A | A | A | A | A | A | A | A | A |
| | H/H (%) | 0.3 | 0.9 | 0.9 | 0.9 | 0.8 | 0.8 | 0.7 | 0.7 | 0.6 | 0.6 | 0.3 | 0.4 | 0.4 |
| | Rank | A | A | A | A | A | A | A | A | A | A | A | A | A |
| | L/L (%) | 0.3 | 0.3 | 0.3 | 0.3 | 0.3 | 0.3 | 0.3 | 0.3 | 0.3 | 0.3 | 0.3 | 0.3 | 0.3 |
| | Rank | A | A | A | A | A | A | A | A | A | A | A | A | A |
| Evaluation 3 | N/N | A | B | B | B | A | A | A | A | A | A | A | A | A |
| | H/H | A | B | B | B | A | A | A | A | A | A | A | A | A |
| Evaluation 4 | Rank | A | B | B | B | A | A | A | A | A | A | A | A | A |
| Evaluation 5 | | 1.22 | 1.60 | 1.55 | 1.53 | 1.50 | 1.48 | 1.46 | 1.44 | 1.42 | 1.40 | 1.22 | 1.38 | 1.36 |
| Evaluation 6 | Density difference | 0.02 | 0.14 | 0.14 | 0.13 | 0.13 | 0.13 | 0.12 | 0.12 | 0.12 | 0.11 | 0.03 | 0.10 | 0.07 |
| | Rank | A | B | B | B | B | B | B | B | B | B | A | B | A |

| | | Example No. | | | | | | | | | | | | |
|---|---|---|---|---|---|---|---|---|---|---|---|---|---|---|
| | | 14 | 15 | 16 | 17 | 18 | 19 | 20 | 21 | 22 | 23 | 24 | 25 | 26 |
| Evaluation 1 | (%) | 0.8 | 2.5 | 0.8 | 2.2 | 1.9 | 2.1 | 1.7 | 1.9 | 1.6 | 1.6 | 1.7 | 1.7 | 0.9 |
| | Rank | A | A | A | A | A | A | A | A | A | A | A | A | A |
| Evaluation 2 | N/N (%) | 0.3 | 0.3 | 0.3 | 0.3 | 0.3 | 0.3 | 0.3 | 0.3 | 0.3 | 0.3 | 0.3 | 0.3 | 0.4 |
| | Rank | A | A | A | A | A | A | A | A | A | A | A | A | A |
| | H/H (%) | 0.3 | 0.3 | 0.3 | 0.3 | 0.3 | 0.3 | 0.3 | 0.3 | 0.3 | 0.3 | 0.3 | 0.3 | 0.4 |
| | Rank | A | A | A | A | A | A | A | A | A | A | A | A | A |
| | L/L (%) | 0.3 | 0.3 | 0.3 | 0.3 | 0.3 | 0.3 | 0.3 | 0.3 | 0.3 | 0.3 | 0.3 | 0.3 | 0.4 |
| | Rank | A | A | A | A | A | A | A | A | A | A | A | A | A |
| Evaluation 3 | N/N | A | A | A | A | A | A | A | A | A | A | A | A | A |
| | H/H | A | A | A | A | A | A | A | A | A | A | A | A | A |
| Evaluation 4 | Rank | A | A | A | A | A | A | A | A | A | A | A | A | A |
| Evaluation 5 | | 1.22 | 1.34 | 1.22 | 1.32 | 1.26 | 1.30 | 1.24 | 1.26 | 1.24 | 1.24 | 1.26 | 1.26 | 1.24 |
| Evaluation 6 | Density difference | 0.09 | 0.09 | 0.08 | 0.07 | 0.06 | 0.06 | 0.05 | 0.05 | 0.05 | 0.04 | 0.04 | 0.04 | 0.03 |
| | Rank | A | A | A | A | A | A | A | A | A | A | A | A | A |

| | | Comparative Example No. | | | | | |
|---|---|---|---|---|---|---|---|
| | | 1 | 2 | 3 | 4 | 5 | 6 |
| Evaluation 1 | (%) | 8.8 | 10.4 | 8.6 | 10.2 | 12.2 | 7.2 |
| | Rank | B | C | B | C | C | B |
| Evaluation 2 | N/N (%) | 3.4 | 1.7 | 3.5 | 1.8 | 3.7 | 3.0 |
| | Rank | C | B | C | B | C | C |
| | H/H (%) | 3.7 | 2.9 | 3.8 | 3.0 | 3.9 | 3.3 |
| | Rank | C | B | C | C | C | C |

TABLE 3-continued

| | | | | | | | |
|---|---|---|---|---|---|---|---|
| | L/L (%) | 3.4 | 1.7 | 3.5 | 1.8 | 3.8 | 3.1 |
| | Rank | C | B | C | B | C | C |
| Evaluation 3 | N/N | C | B | C | B | C | C |
| | H/H | C | C | C | C | C | C |
| Evaluation 4 | Rank | C | C | C | C | C | C |
| Evaluation 5 | | 2.82 | 2.40 | 2.91 | 2.52 | 3.20 | 2.63 |
| Evaluation 6 | Density difference | 0.24 | 0.18 | 0.25 | 0.19 | 0.27 | 0.22 |
| | Rank | D | C | E | C | E | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-013690, filed Jan. 30, 2018, Japanese Patent Application No. 2018-195525, filed Oct. 17, 2018, which are hereby incorporated by reference herein in their entirety.

What is claimed is:

1. A toner comprising toner particles, each of which include a binder resin, a colorant and a wax, wherein in a cross section of the toner particles observed under a scanning transmission electron microscope the number of toner particles having a void with a void long diameter of 0.50 μm or less in the total number of whole toner particles is at least 60 number %, and the number of toner particles having a void in a region from an outline of the cross section of the toner particle inward to 1.00 μm of a total number of toner particles having a void is 20 number % or less.

2. The toner according to claim 1, wherein in the cross section of the toner particles observed under a scanning transmission electron microscope the number of toner particles having a void with a void long diameter of 1.00 μm or more of the total number of toner particles is 20 number % or less.

3. The toner according to claim 1, wherein in the cross section of the toner particles observed under a scanning transmission electron microscope two or more voids with a void long diameter of 0.50 μm or less are present in each of the toner particles.

* * * * *